US007819512B2

(12) United States Patent
Hattori

(10) Patent No.: US 7,819,512 B2
(45) Date of Patent: Oct. 26, 2010

(54) PACKAGING ARRANGEMENTS

(75) Inventor: Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 518 days.

(21) Appl. No.: 11/959,387

(22) Filed: Dec. 18, 2007

(65) Prior Publication Data

US 2009/0058959 A1 Mar. 5, 2009

Related U.S. Application Data

(63) Continuation-in-part of application No. 11/862,976, filed on Sep. 27, 2007, now Pat. No. 7,416,291.

(30) Foreign Application Priority Data

Aug. 31, 2007 (JP) ..... 2007-227147

(51) Int. Cl.
*B41J 2/175* (2006.01)

(52) U.S. Cl. ..... 347/86

(58) Field of Classification Search ..... 347/84–86; 206/229, 441, 497

See application file for complete search history.

(56) References Cited

U.S. PATENT DOCUMENTS

| | | | |
|---|---|---|---|
| 6,464,339 | B1 | 10/2002 | Ardito |
| 7,121,655 | B2 | 10/2006 | Silverbrook |
| 2005/0168540 | A1 | 8/2005 | Wilson et al. |
| 2006/0203051 | A1 | 9/2006 | Kanbe |
| 2007/0070147 | A1 | 3/2007 | Hattori et al. |

FOREIGN PATENT DOCUMENTS

| | | | |
|---|---|---|---|
| DE | 20316502 | U1 | 1/2004 |
| EP | 1769922 | A1 | 4/2007 |
| EP | 1772270 | A2 | 4/2007 |
| EP | 1886821 | A2 | 2/2008 |
| JP | 2006159707 | A | 6/2006 |

OTHER PUBLICATIONS

European Patent Office, European Search Report for Related EP Application No. 08003695 dated May 29, 2008.

*Primary Examiner*—Stephen D Meier
*Assistant Examiner*—Geoffrey Mruk
(74) *Attorney, Agent, or Firm*—Baker Botts L.L.P.

(57) ABSTRACT

A packaging arrangement includes an ink cartridge and a packaging member enclosing the ink cartridge. The ink cartridge includes a body, a movable member, and at least one resilient member disposed between the body and the movable member. The movable member is configured to move between a first position and a second position relative to the body when the at least one resilient member expands and contracts, and a distance between the second position and the body is less than a distance between the first position and the body. A pressure inside the packaging member is less than a pressure outside the packaging member, and the movable member is retained in the second position when the ink cartridge is enclosed within the packaging member.

11 Claims, 20 Drawing Sheets

PACKAGING ARRANGEMENTS

CROSS-REFERENCE TO RELATED APPLICATIONS

The present application is a continuation in part application of U.S. patent application Ser. No. 11/862,976 ("the '976 application"), which was filed on Sep. 27, 2007, and claims priority from Japanese Patent Application No. JP-2007-227147, which was filed on Aug. 31, 2007, and the '976 application, the disclosures of which are incorporated herein by reference in their entirety.

BACKGROUND OF THE INVENTION

1. Field of the Invention

The present invention relates generally to packaging arrangements in which an ink cartridge is enclosed in a packaging member, a pressure inside the packaging member is less than a pressure outside the packaging member.

2. Description of Related Art

A known ink cartridge is configured to be mounted to and removed from a known inkjet recoding apparatus. The known ink cartridge has an ink chamber configured to store ink, and when the ink cartridge is mounted to the recording apparatus, ink is supplied from the ink chamber to the recording apparatus. The ink chamber is defined by a frame and a pair of films which are adhered to opposite faces of the frame.

In the known ink cartridge, ink is stored in the ink chamber, and the pressure inside the ink chamber is reduced to be less than the atmospheric pressure, which increases the degree of deaeration in the ink chamber, and thereby prevents generation of air bubbles in the ink chamber. Moreover, the ink cartridge is packaged in a package bag, and the pressure inside the package bag is reduced to be less than the pressure in the ink chamber, which prevents air from entering the ink chamber through the pair of films.

Nevertheless, in the known ink cartridge, when the ink cartridge is packaged in the package bag and the inside of the package bag is depressurized, a component of the ink cartridge may be deformed by the pressure differential between the pressure inside the package bag and the atmospheric pressure. Such deformation may adversely affect the operation of the ink cartridge.

SUMMARY OF THE INVENTION

Therefore, a need has arisen for packaging arrangements which overcome these and other shortcomings of the related art. A technical advantage of the present invention is that deformation of a component of the ink cartridge may be suppressed.

According to an embodiment of the present invention, a packaging arrangement comprises an ink cartridge and a packaging member enclosing the ink cartridge. The ink cartridge comprises a body, a movable member, and at least one resilient member. The body comprises a particular face, the body has at least a portion of an ink chamber defined therein, and the ink chamber is configured to store ink. The movable member is configured to move between a first position and a second position relative to the body, and a distance between the second position and the particular face of the body is less than a distance between the first position and the particular face of the body. The at least one resilient member is disposed between the particular face of the body and the movable member. The at least one resilient member is configured to expand and to contract to move the movable member relative to the case between the first position and the second position, and the at least one resilient member applies a biasing force to the movable member to bias the movable member into the first position. A pressure inside the packaging member is less than a pressure outside the packaging member, and the movable member is retained in the second position when the ink cartridge is enclosed within the packaging member.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1(A)-20, like numerals being used for like corresponding portions in the various drawings.

Figure 1B:
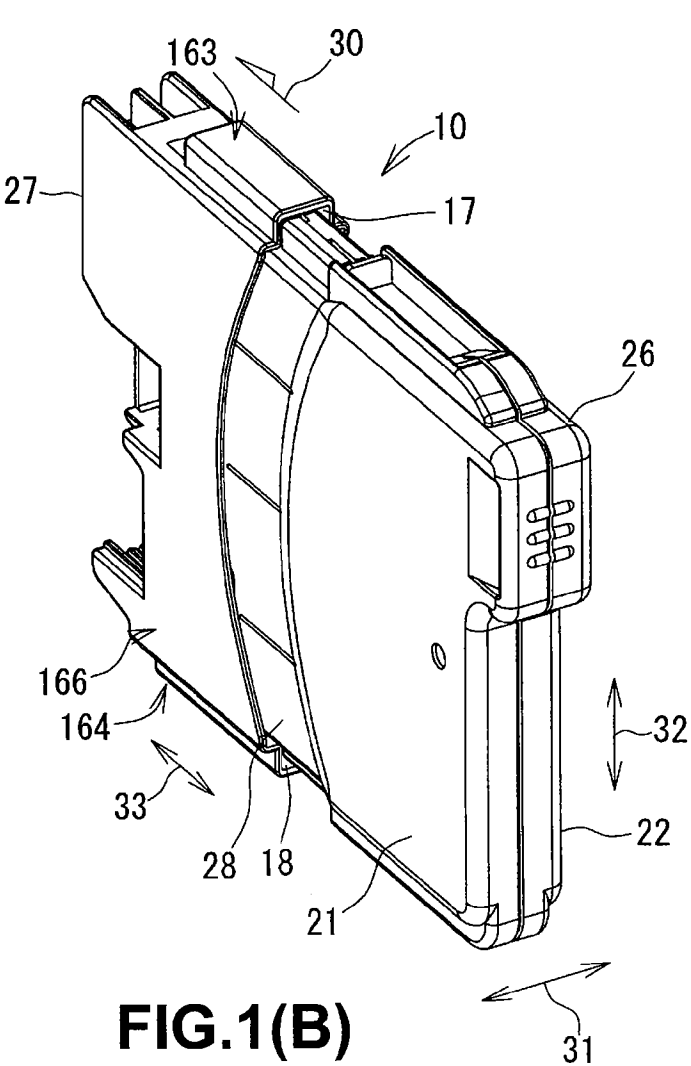
FIGS. 1(A) and 1(B) are a front-face perspective view and a rear-face perspective view of an ink cartridge, respectively, according to an embodiment of the present invention.
Figure 1A:
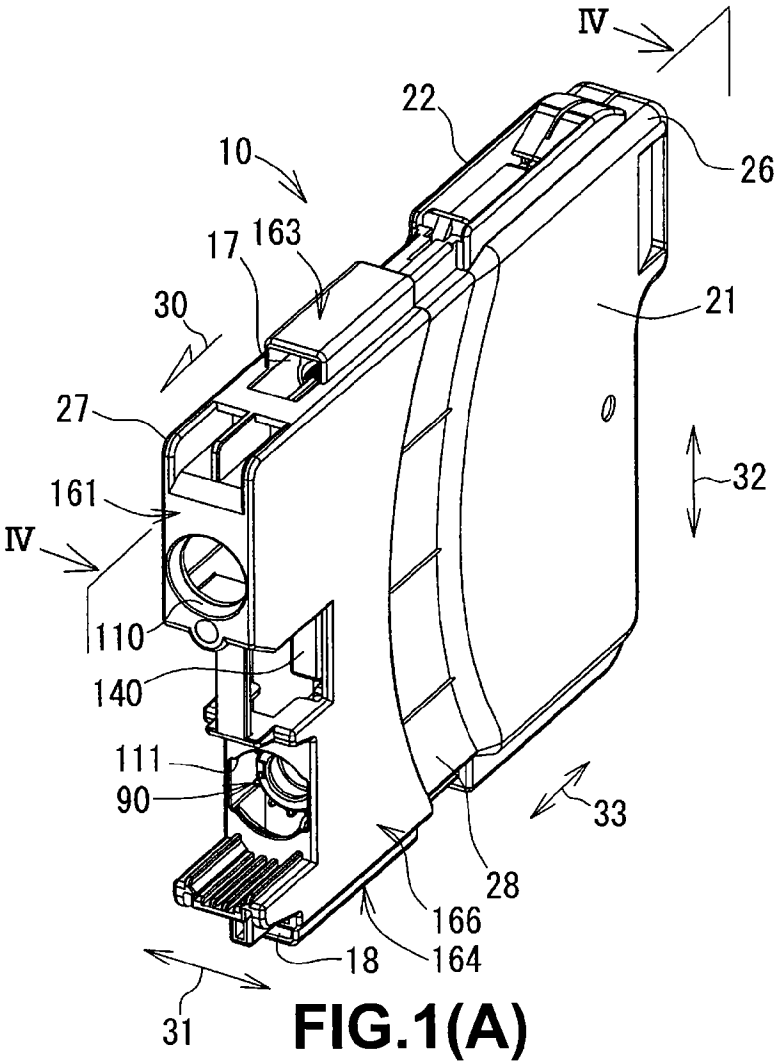
Figure 2:
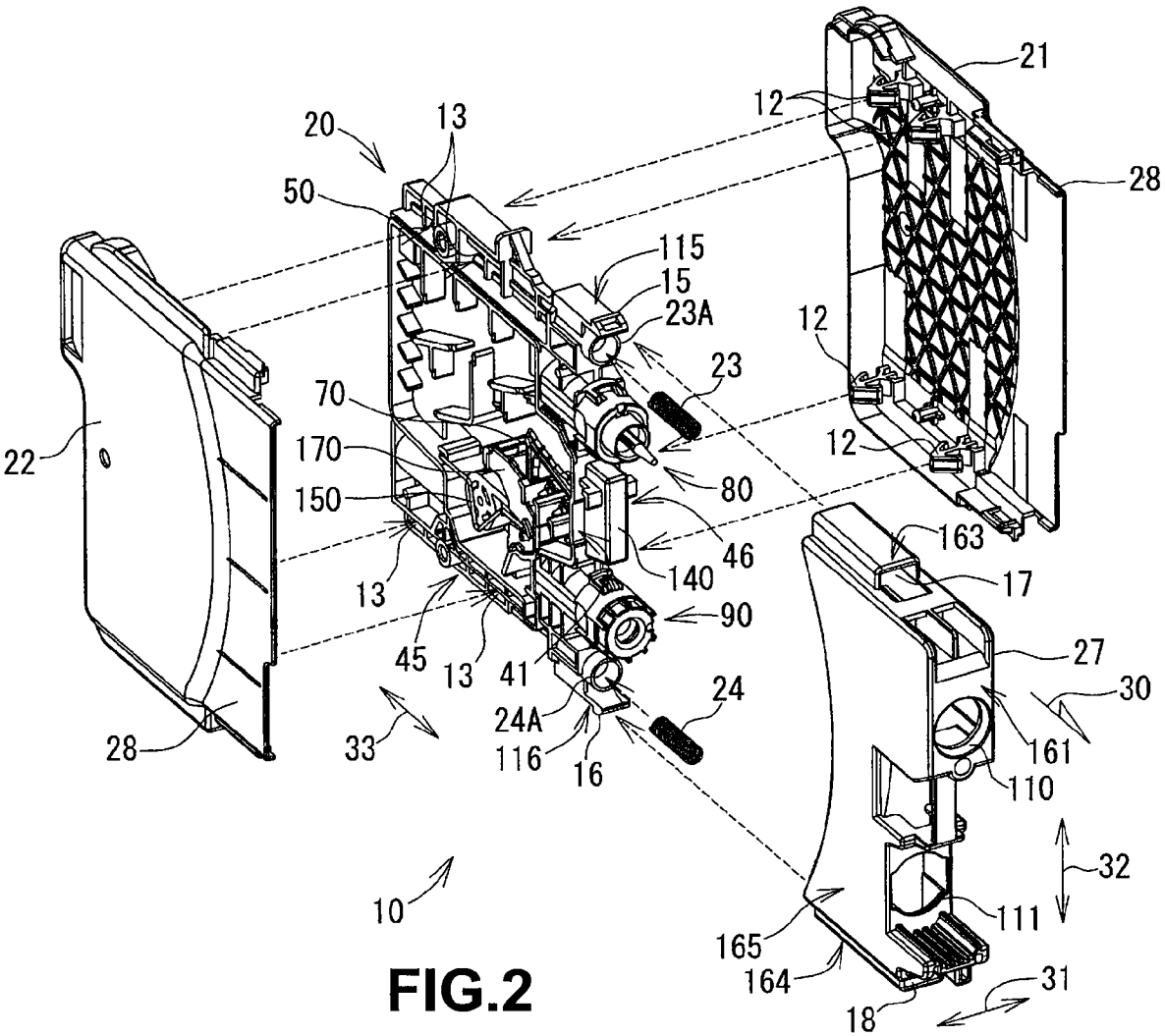
FIG. 2 is an exploded, perspective view of the ink cartridge of FIGS. 1(A) and 1(B).

Referring to FIGS. 1(A) and 1(B), an ink cartridge 10, according to an embodiment of the present invention, is depicted. An image recording apparatus (not shown), e.g., an inkjet printer, may use ink cartridge 10 to form an image on a recording medium (not shown), e.g., paper. The ink cartridge 10 is configured to be mounted to and removed from a cartridge storage section (not shown) of the image recording apparatus. The ink cartridge 10 may be mounted to the cartridge storage section by inserting ink cartridge 10 in a direction indicated by an arrow 30 in FIG. 1. After the ink cartridge 10 is mounted in the cartridge storage section, ink stored in the ink cartridge 10 may be supplied to a recording head (not shown) of the image recording apparatus.

The ink cartridge 10 may have a substantially flat, hexahedron shape. A width of the ink cartridge 10, as indicated by an arrow 31, may be relatively short, and each of a height of the ink cartridge 10, as indicated by an arrow 32, and a depth of the ink cartridge 10, as indicated by an arrow 33, may be greater than the width of the ink cartridge 10.

Referring to FIGS. 1(A)-3(B), the ink cartridge 10 may comprise a container body 20, a housing 26, a movable member, e.g., a slider 27, and at least one resilient member, e.g., a pair of coil springs 23 and 24. The housing 26 and the slider 27 may enclose the container body 20.

The housing 26 is configured to protect the container body 20. Substantially the entirety of the container body 20 other than a front face 41 of the container body 20 may be covered by the housing 26. The housing 26 may comprise a first cover member 21 and a second cover member 22 configured to sandwich the container body 20 from the right and left in FIG. 2. In an embodiment, a pair of films 65 may be covered by the first cover member 21 and the second cover member 22.

The first cover member 21 is attached to a right side face 46 of the container body 20. The first cover member 21 may comprise a plurality of engaging claws 12 extending from an inner wall surface thereof, and the container body 20 may comprise a plurality of engaging grooves 13 formed therein. The plurality of engaging claws 12 may be fitted into the plurality of engaging grooves 13, respectively, such that the right side face 46 of the container body 20 is covered by the first cover member 21. Similarly, the second cover member 22 is attached to a left side face 45 of the container body 20. The second cover member 22 comprises a plurality of engaging claws (not shown) extending from an inner wall surface thereof, and the plurality of engaging claws are fitted in the plurality of engaging grooves 13, respectively, such that the left side face 45 of the container body 20 is covered by the second cover member 22.

The container body 20 may comprise a sealing member, e.g., an air communication valve mechanism 80, and an ink supply valve mechanism 90 positioned at the front face 41 thereof. The slider 27 is configured to protect the air communication valve mechanism 80 and the ink supply valve mechanism 90. The slider 27 may be coupled to the container body 20 by the coil springs 23 and 24 positioned therebetween, and is configured to move relative to the container body 20. An end of the coil spring 23 is received in a spring receiver 23A formed in an upper portion of the front face 41 of the container body 20, and an end of the coil spring 24 is received in a spring receiver 24A formed in a lower portion of the front face 41 of the container body 20.

Figure 3A:
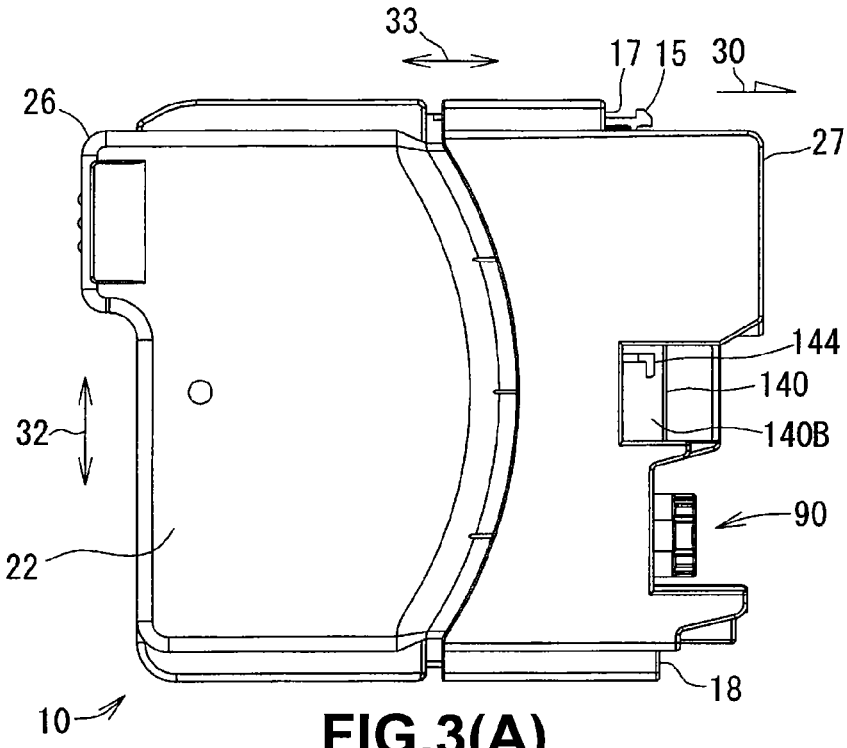
FIGS. 3(A) and 3(B) are side views of the ink cartridge of FIGS. 1(A) and 1(B), respectively, in which a movable member, such as a slider, is in a second position and a first position, respectively.
Figure 3B:
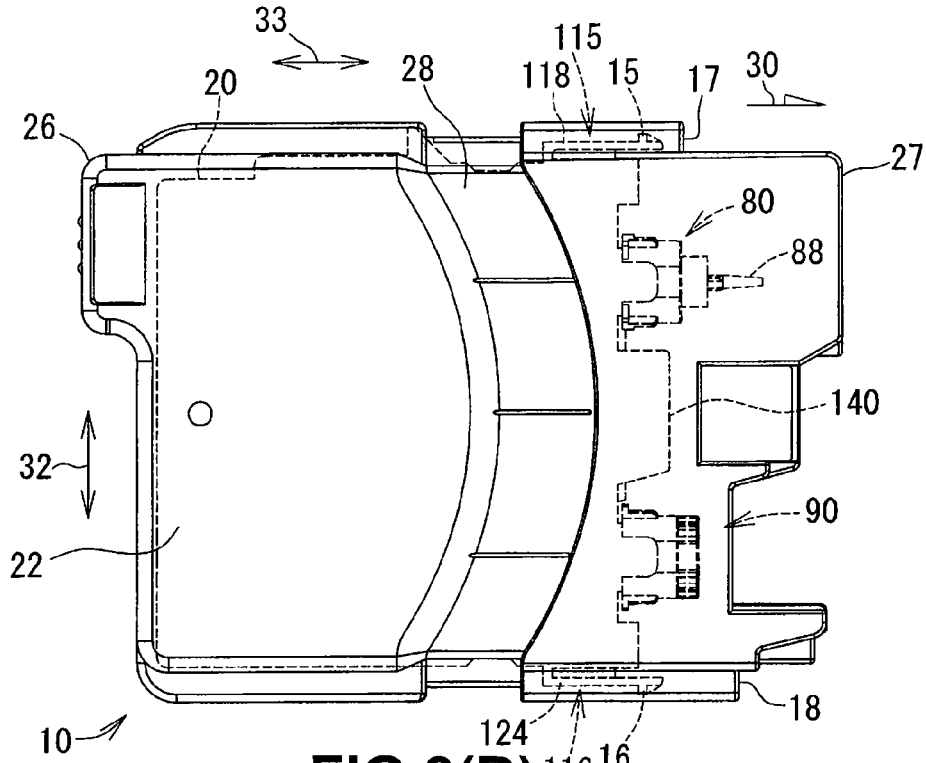
Figure 4:
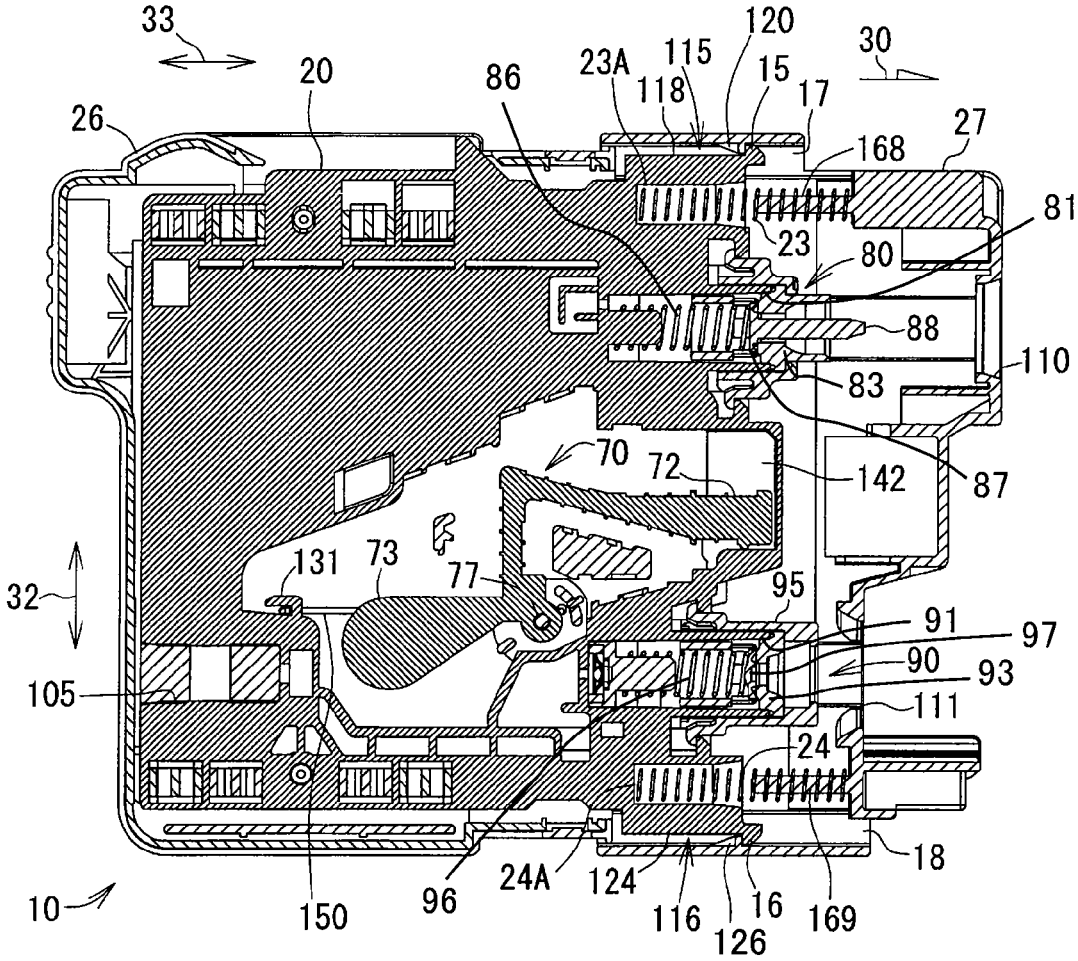
FIG. 4 is a cross-sectional view of the ink cartridge of FIG. 1(A) taken along a line IV-IV of FIG. 1(A).
Figure 5:
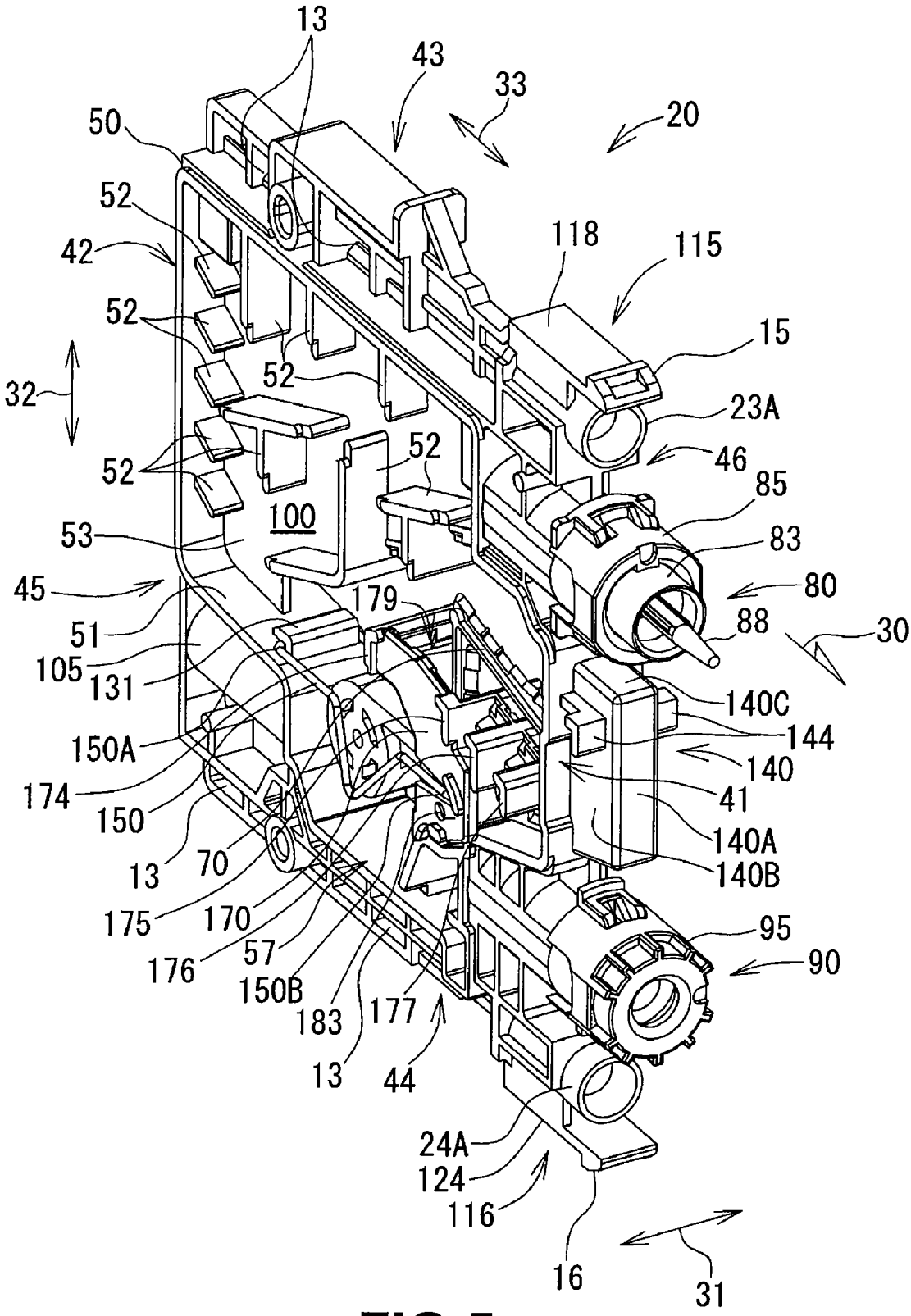
FIG. 5 is a perspective view of a container body, according to an embodiment of the present invention.

The slider 27 may be configured to contact and slide on the front portion 28 of the housing 26 between a first position and a second position in the depth direction, as indicated by the arrow 33, when coil springs 23 and 24 expand and contract. When the slider 27 is at the second position, as depicted in FIG. 3(A), the slider 27 is positioned closer to the front face 41 of the container body 20 than when the slider 27 is in the first position, and when the slider 27 is at the first position, as depicted in FIG. 3(B), the slider 27 is positioned further from the front face 41 of the container body 20 than when the slider 27 is in the second position. When a predetermined amount of force greater than a biasing force of the coil springs 23 and 24 is applied to the slider 27, the slider 27 moves from the first position to the second position. When the slider 27 is in the second position, an opening 110 formed through the slider 27 is positioned adjacent to the air communication valve mechanism 80, and the ink supply valve mechanism 90 extends outside the slider 27 via an opening 111 formed through the slider 27. When the predetermined amount of force is released from the slider 27, the slider 27 subsequently moves from the second position to the first position, the opening 110 of the slider 27 moves away from the air communication valve mechanism 80, and the ink supply valve mechanism 90 is positioned within the slider 27.

Referring to FIGS. 4-10, the container body 20 may have a substantially flat, hexahedron shape having the front face 41, a rear face 42 opposite the front face 41, a top face 43, a bottom face 44 opposite top face 43, the left side face 45, and the right side face 46 opposite the left side face 45. Each of the top face 43 and the bottom face 44 is connected to the front face 41 and the rear face 42, and each of the left side face 45 and the right side face 46 is connected to the front face 41, the rear face 42, the top face 43, and the bottom face 44. Moreover, the area of the left side face 45 and the area of the right side face 46 are each greater than each of the area of the front face 41, the area of the rear face 42, the area of the top face 43, and the area of the bottom face 44.

The container body 20 may comprise a frame 50, a pivotable member 70, a supporting member, e.g., a supporting block 170, a protecting member 150, the air communication valve mechanism 80, the ink supply valve mechanism 90, and the pair of films 65. The frame 50 defines the six faces 41-46 of the container body 20, such that the six faces 41-46 of the container body 20 correspond to six faces of the frame 50.

The frame 50 may comprise a translucent resin material, e.g., a transparent material or a semi-transparent material, and light may pass therethrough. In this embodiment, the frame 50 may be manufactured by injection-molding polypropylene. Alternatively, the frame 50 may be manufactured by injection-molding polyacetal, nylon, polyethylene, or the like.

The frame 50 may comprise an outer peripheral wall 51 and a plurality of inner walls or inner ribs 52. The inner walls or inner ribs 52 are positioned inside the outer peripheral wall 51. The outer peripheral wall 51 and the inner walls or inner ribs 52 may be integral and may define the frame 50. The outer peripheral wall 51 and the inner walls or inner ribs 52 extend from the left side face 45 to the right side face 46 of the frame 50. The outer peripheral wall 51 may have a substantially square or rectangular perimeter extending along the front face 41, the top face 43, the rear face 42, and the bottom surface 44 defining a space in the interior thereof. Accordingly, openings 57 are formed on the left side face 45 and the right side face 46, respectively, of the frame 50, such that the left side face 45 and the right side face 46 of the frame 50 are opened.

The pair of films 65, e.g., translucent films, may be connected to, e.g., adhered to, the side faces 45 and 46, respectively, of the frame 50 via an adhesion method, e.g., a thermal adhesion method. More specifically, the pair of films 65 may be adhered to both ends of the outer peripheral wall 51 in the width direction 31. The openings 57 may be closed by the pair of films 65, and a space surrounded by the outer peripheral wall 51 and the pair of films 65 comprises an ink chamber 100 configured to store ink therein. Alternatively, a container-shaped frame which is opened on the right side face 46 may be used instead of the frame 50. In this case, the ink chamber 100 is defined by the film 65 adhered to the right side face 46 of the container-shaped frame.

The frame 50 may comprise a partitioning member, e.g., a partitioning plate 53, extending from the outer peripheral wall 51, which may partition an upper space of the ink chamber 100 at the center in the width direction 31. The inner walls or inner ribs 52 extend from the outer peripheral wall 51 or the partitioning plate 53. The pair of films 65 also may be adhered to the inner walls or inner ribs 52 at both ends thereof in the width direction 31. Consequently, the inner walls or inner ribs 52 may restrict the ability of the pair of films 65, the first cover member 21, and/or the second cover member 22 to move inward, such that the inner walls or inner ribs 52 may limit an amount of deformation of the pair of films 65. A lower portion of the ink chamber 100, e.g., a space 102 below the partitioning panel 53, may not be partitioned in the width direction 31 and may extend from the left side face 45 to the right side face 46, such that the pivotable member 70 and the supporting block 170 are positioned therein.

In an embodiment, each of the pair of films 65 may comprise a plurality of layered, synthetic resin films. For example, each of the pair of films 65 may comprise three layers. The innermost layer may comprise a polypropylene, and may comprise the same material as the frame 50. The innermost layer of the pair of films 65 may be adhered to the frame 50. The outermost layer may comprise a polyethylene terephthalate, and the layer sandwiched by the innermost layer and the outermost layer may comprise a nylon. In another embodiment, each of the pair of films 65 may comprise a metal foil sandwiched by synthetic resins. In yet another embodiment, each of the pair of films 65 may comprise a pulp, a metal, or a natural resin.

The frame 50 may comprise a rib 74 positioned at a right-side face 46 side of the outer peripheral wall 51, such that the rib 74 is positioned adjacent to a corner between the front face 41 and the bottom face 44. A cylindrical tube 67 extends from the rib 74 towards the left side face 45. A shaft 77 having a column shape may have a first end fitted into the cylindrical tube 67, and a second end which is supported by the supporting block 170. The shaft 77 extends through a shaft hole 78 of the pivotable member 70.

The frame 50 may comprise a cylindrical ink introduction chamber 105 formed in the rear face 42 of the frame 50 adjacent to the lower end of the rear face 42. The ink introduction chamber 105 extends from the rear face 42 towards the ink chamber 100. The ink introduction chamber 105 is configured to be in fluid communication with the ink chamber 100. Ink is introduced into the ink chamber 100 through the ink introduction chamber 105 during the manufacturing process of the ink cartridge 10. More specifically, air is removed from the interior of the ink chamber 100 until the pressure in the ink chamber 100 is reduced to a predetermined pressure. Because of the pressure differential between the interior and the exterior of the ink chamber 100, when a needle (not shown) is inserted into the ink introduction chamber 105, ink is drawn into the ink chamber 100 via the ink introduction chamber 105. As ink is drawn into the ink chamber 100, the pressure inside the ink chamber 100 increases. Nevertheless, the predetermined pressure is selected, such that after a sufficient amount of ink is introduced into the ink chamber 100 e.g., the ink chamber 100 is substantially full, the pressure in the ink chamber 100 is slightly less than the atmospheric pressure.

The frame 50 may comprise a translucent portion 140 positioned at the front face 41 and extending away from the ink chamber 100. An amount of ink stored in the ink chamber 100 may be optically or visually detected via the translucent portion 140. The translucent portion 140 may be integral with frame 50, and may comprise the same material as frame 50, e.g., the translucent portion 140 may comprise a translucent resin material which allows light to pass therethrough.

The translucent portion 140 may project outward from a center portion of front face 41 of the frame 50 away from the ink chamber 100. The translucent portion 140 may comprise five rectangular walls and have a substantially a hollow box shape. For example, the translucent portion 140 may comprise a front wall 140A, a pair of side walls 140B, a top wall 140C, and a bottom wall 140D. The front wall 140A extends parallel to the front face 41 and is separated from the front face 41 by a predetermined distance. The pair of side walls 140B are connected to the front face 41 and the front wall 140A, the top wall 140C is connected to top ends of the front wall 140A and the side walls 140B, and the bottom wall 140D is connected to bottom ends of the front wall 140A and the side walls 140B. Moreover, the width of the front wall 140A is less than the width of the front face 41. The translucent portion 140 is configured to receive light emitted from an optical sensor, e.g., a photo interrupter. When ink cartridge 10 is mounted to the image forming apparatus, a light emitting portion of a photo interrupter may face one of the side walls 140B and a light receiving portion of the photo interrupter may face the other of the side walls 140B. The light emitted from the light emitting portion of the photo interrupter may pass through the side walls 140B and reach the light receiving portion of the photo interrupter.

The translucent portion 140 may have an inner space 142 formed therein, which is defined by the front wall 140A, the side walls 140B, the top wall 140C, and the bottom wall 140D of the translucent portion 140. The inner space 142 is configured to be in fluid communication with the interior of the ink chamber 100. An indicating portion 72 of the pivotable member 70 may be configured to move within the inner space 142 between an upper position and a lower position based on an amount of ink in the ink chamber 100.

At least one engaging claw 144 may be formed on each of the side walls 140B of the translucent portion 140. Each engaging claw 144 extends outward from one of the side walls 140B in a direction perpendicular to the side walls 140B. Each engaging claw 144 may have a hook shape.

When the ink cartridge 10 is mounted to the image forming apparatus, the air communication valve mechanism 80 is positioned above the translucent portion 140. The air communication valve mechanism 80 is configured to selectively open and close an opening 81 formed through an upper portion of the front face 41 of the frame 50, such that air communication valve mechanism 80 selectively allows and prevents fluid communication between the interior of the ink chamber 100 and the exterior of the ink chamber 100 via the opening 81. The air communication valve mechanism 80 may comprise a valve member 87, a rod 88 extending from the valve member 87, an urging member, e.g., a spring 86, a stopper 83, and a cap 85.

The stopper 83 has an opening formed therethrough. The stopper 83 is partially positioned in the opening 81, but does not close the opening 81 completely because the opening is formed through the stopper 83. The valve member 87 is configured to move between an opened position in which the valve member 87 is separated from the stopper 83, and a closed position in which the valve member 87 contacts the stopper 83. When the valve member 87 is positioned in the opened position, the opening of the stopper 83 is not closed by the valve member 87, such that the opening 81 is opened. When the valve member 87 is positioned in the closed position, the opening of the stopper 83 is closed, such that the opening 81 is closed. The valve member 87 is resiliently urged by the spring 86 toward the stopper 83, such that the valve member 87 is in the closed position unless a force substantially opposite and greater than the biasing force of the spring 86 is applied to the valve member 87.

When the ink cartridge 10 is mounted to the image forming apparatus, the ink supply valve mechanism 90 is positioned below the translucent portion 140. The ink supply valve mechanism 90 may be configured to selectively open and close an opening 91 formed through a lower portion of the front face 41 of the frame 50, such that the ink supply valve mechanism 90 selectively allows and prevents fluid communication between the interior of the ink chamber 100 and the exterior of the ink chamber 100 via the opening 91. The ink supply valve mechanism 90 may comprise a valve member 97, a spring 96, a spring receiver 94, a stopper 93, and a cap 95. The stopper 93 has an opening formed therethrough. The stopper 93 is partially positioned in the opening 91, but does not close the opening 91 completely because the opening is formed through the stopper 93. The valve member 97 is configured to move between an opened position in which the valve member 97 is separated from the stopper 93, and a closed position in which the valve member 97 contacts the stopper 93. When the valve member 97 is positioned in the opened position, the opening of the stopper 93 is not closed by the valve member 97, such that the opening 91 is opened. When the valve member 97 is positioned in the closed position, the opening of the stopper 93 is closed, such that the opening 91 is closed. The valve member 97 is resiliently urged by the spring 96 toward the stopper 93, such that the ink supply valve mechanism 90 is in the closed position unless a force substantially opposite and greater than the biasing force of the spring 96 is applied to the valve member 97. When the ink cartridge 10 is mounted to the image recording apparatus, the valve member 97 is pushed by a tube of the image recording apparatus against the biasing force of the spring 96, and the opening 91 is opened. Consequently, ink in the ink chamber 100 is allowed to flow from the opening 91 to the image recording apparatus via the tube.

A supporting member 115 may be positioned on the top face 43 of the frame 50 adjacent to the front face 41 of the frame 50. The supporting member 115 may be integral with the frame 50. The supporting member 115 is configured to support the slider 27, such that the slider 27 slides with respect to the container body 20. The supporting member 115 also is configured to restrict the sliding range of the slider 27. The slider 27 may be slidably supported by the supporting member 115 and a supporting member 116. The supporting member 115 may comprise a seat 118 extending away from the top face 43 in a direction perpendicular to the top face 43, and a hook-shaped engaging claw 15 which is positioned at and extends from the front end of the seat 118 in a direction perpendicular to the top face 43.

The supporting member 116 may be formed on the bottom face 44 of the frame 50 adjacent to the front face 41 of the frame 50. The supporting member 116 may have substantially the same shape as the supporting member 115. The supporting member 116 may be integral with the frame 50, and may comprise a seat 124 extending away from the bottom face 44 in a direction perpendicular to the bottom face 44, and a hook-shaped engaging claw 16 which is positioned at and extends from the front end of the seat 124 in a direction perpendicular to the bottom face 44.

Figure 6:
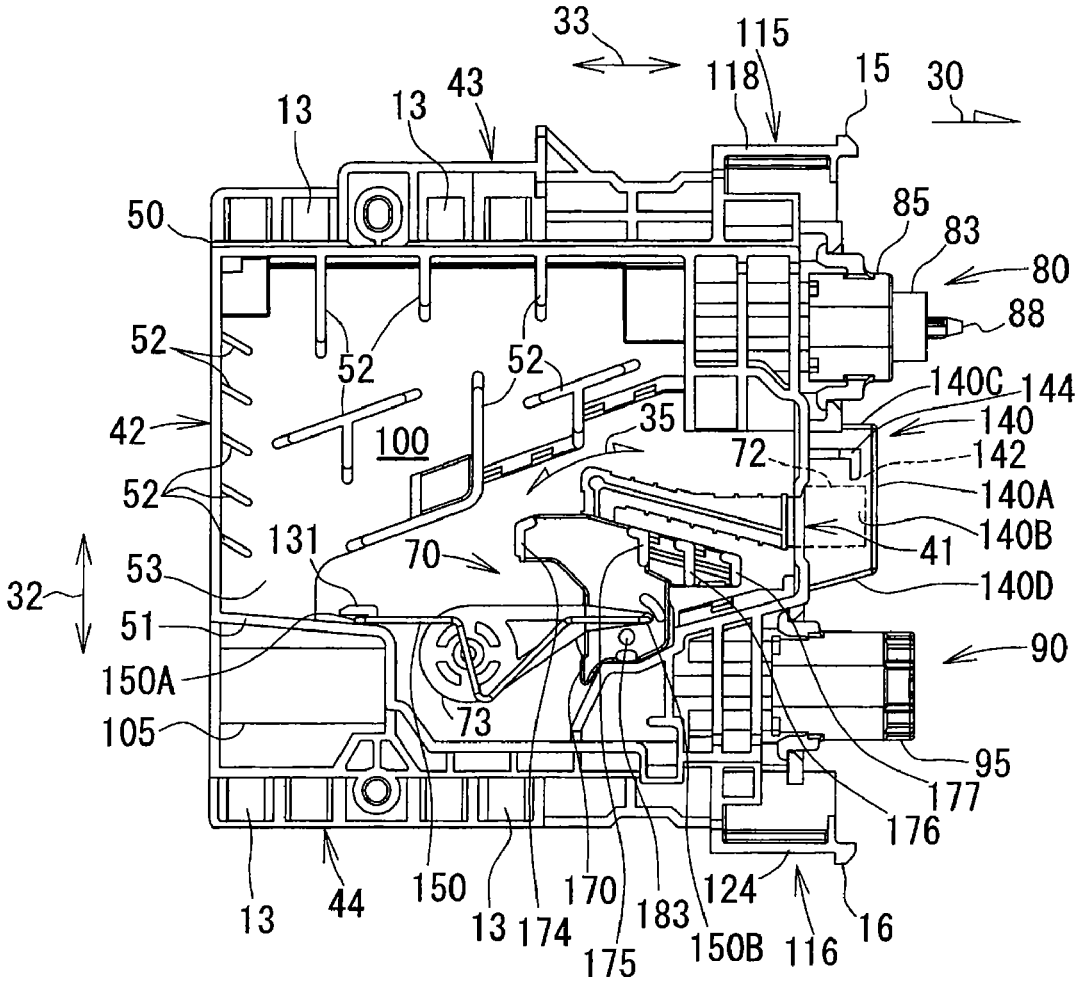
FIG. 6 is a side view of the container body of FIG. 5.
Figure 7:
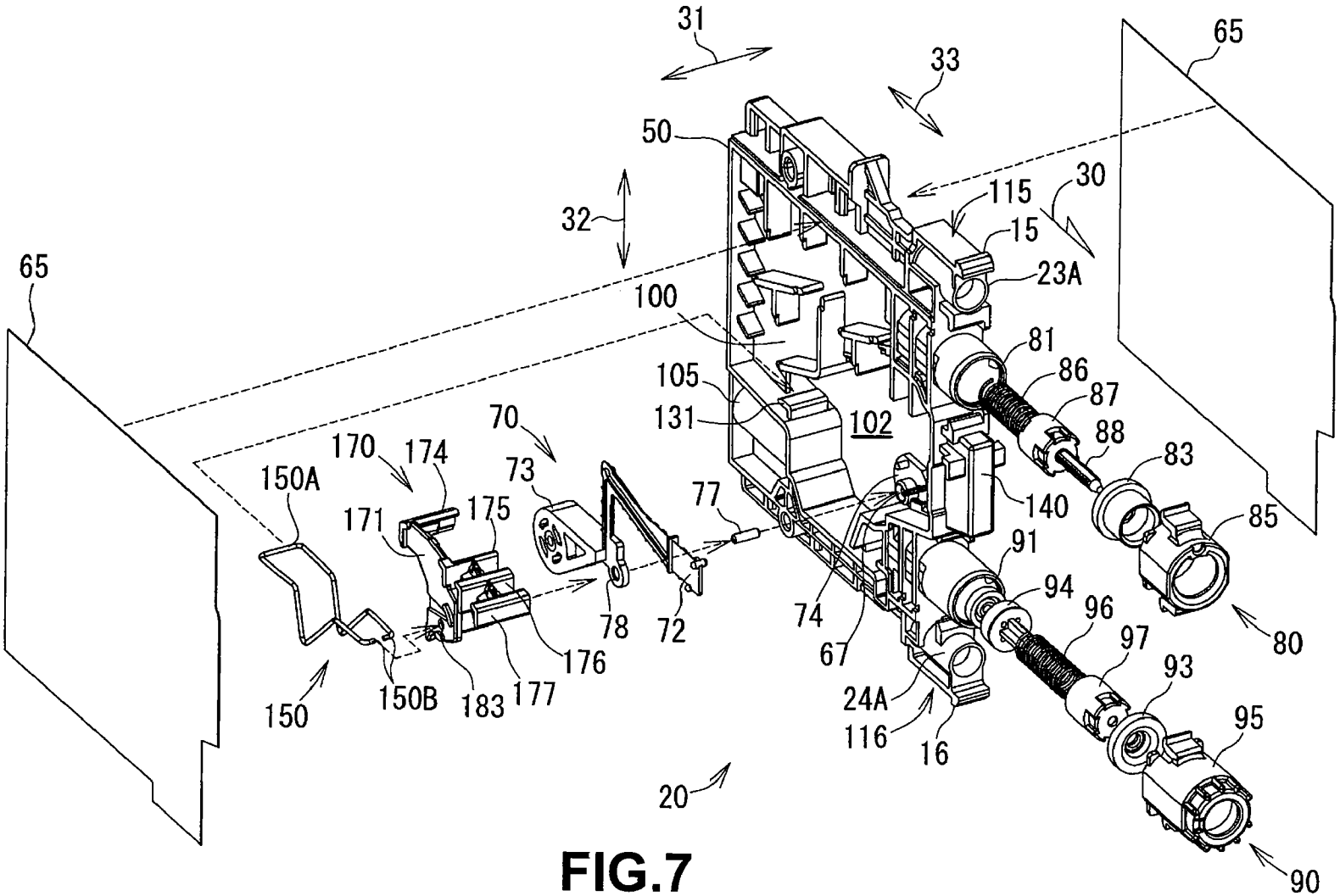
FIG. 7 is an exploded, perspective view of container body of FIG. 5, in which the container body comprises a pair of film walls.
Figure 8:
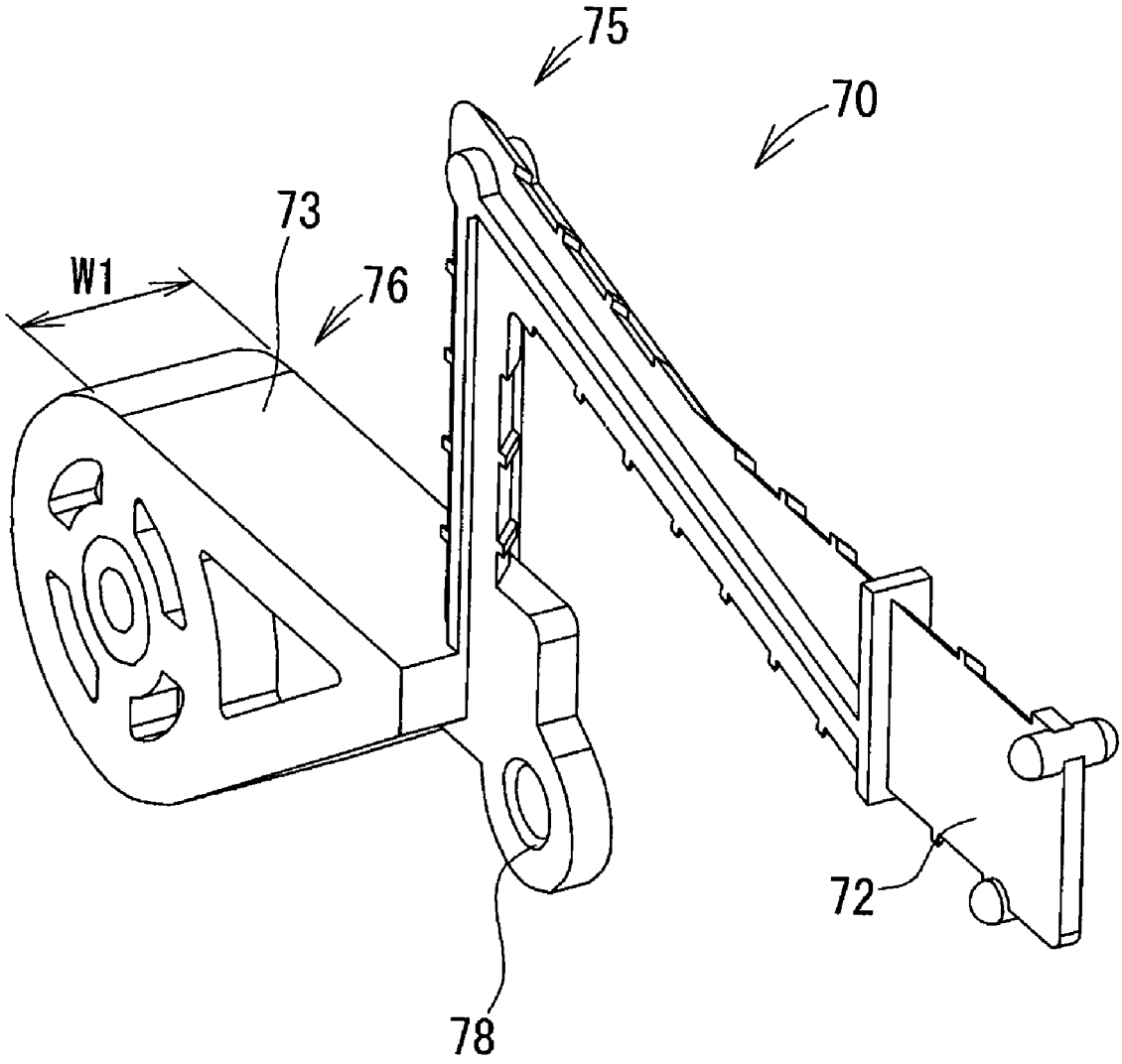
FIG. 8 is a perspective view of a pivotable member, according to an embodiment of the present invention.

Referring to FIGS. 6-8, the pivotable member 70 is configured to indicate whether the ink chamber 100 has a sufficient amount of ink stored therein. The indicating portion 72 is positioned at a first end of the pivotable member 70, and a float portion 73 is positioned at a second end of the pivotable member 70.

The pivotable member 70 has the shaft hole 78 formed therethrough. The shaft hole 78 may be positioned between the first end of the pivotable member and the second end of the pivotable member. The shaft 77 is inserted into the shaft hole 78, and the shaft 77 may support the pivotable member 70, such that the pivotable member 70 pivots about the shaft 77 in a direction indicated by an arrow 35 in FIG. 6. The shaft 77 is supported by the cylindrical tube 67 formed on the rib 74 at one end thereof, and by the supporting block 170 at the other end thereof. Alternatively the shaft 77 may be integral with the pivotable member 70.

The specific gravity of float portion 73 is less than the specific gravity of ink stored in the ink chamber 100. The float portion 73 may have a hollow formed therein, and floats on liquid, such that the float portion 70 moves upward and downward based on the amount of ink within the ink chamber 100, and the pivotable member 70 pivots based on the movement of float portion 73. In another embodiment, the float portion 73 does not have the hollow, and comprises a material having a specific gravity less than the specific gravity of ink.

When the pivotable member 70 pivots clockwise in FIG. 6, the indicating portion 72 contacts the bottom wall 140D of the translucent portion 140, such that further movement of the pivotable member 70 is prevented, and the indicating portion 72 is positioned at the lower position. Similarly, when the pivotable member 70 pivots counterclockwise in FIG. 6, the indicating portion 72 moves away from the bottom wall 140D of the translucent portion 140, and the float portion 73 contacts a bottom surface of the ink chamber 100. When the float portion 73 contacts the bottom surface of the ink chamber 100, further movement of the pivotable member 70 is prevented, and the indicating portion 72 is at the upper position and separated from the bottom wall 140D of the translucent portion 140 by a predetermined distance.

The pivotable member 70 may comprise a first portion 75 extending from the shaft hole 78 to the indicating portion 72, and a second portion 76 extending from the shaft hole 78 to the float portion 73. The mass of the first portion 75 of the pivotable member 70 may be less than the mass of the second portion 76 of the pivotable member 70, such that when the second portion 76 of the pivotable member 70 and the first portion 75 of the pivotable member 70 are in the same medium as each other, the second portion 76 of the pivotable member 70 is heavier than the first portion 75 of the pivotable member 70. Accordingly, when the amount of ink stored in the ink chamber is less than a sufficient amount of ink, the pivotable member 70 pivots counterclockwise about the shaft 77 in FIG. 6, and the indicating portion 72 separates from the bottom wall 140D of the translucent portion 140. When the lower end of the float portion 73 contacts the bottom surface of the ink chamber 100, the pivotable member 70 stops pivoting and the indicating portion 72 is positioned at the upper position. When the indicating portion 72 is at the upper position, it may be determined that the ink chamber 100 has an insufficient amount of ink stored therein.

In contrast, when a sufficient amount of ink is stored in the ink chamber 100, the float portion 73 is submerged in the ink, and a buoyancy force acts on the float portion 73. The buoyancy force is great enough to cause the pivotable member 70 to pivot clockwise about the shaft 77 in FIG. 6. When the pivotable member 70 pivots clockwise, the indicating portion 72 contacts the bottom wall 140D of the translucent portion 140, and the pivotable member 70 stops pivoting and the indicating portion 72 is positioned at the lower position. When the indicating portion 72 is at the lower position, it may be determined that the ink chamber 100 has a sufficient amount of ink stored therein.

Whether or not the ink chamber 100 has a sufficient amount of ink stored therein may be determined by a user viewing the position of the indicating portion 72 in the inner space 142, or by using an optical sensor e.g., a photo interrupter, to monitor the position of the indicating portion 72.

Referring to FIGS. 6 and 7, the protecting member 150 is positioned around the pivotable member 70. The protecting member 150 may be manufactured by bending a linear steel wire. The protecting member 150 may comprise a U-shaped portion 150A which may be received by a hook 131 formed on the frame 50, and ends 150B of the protecting member 150 may be inserted into a hole (not shown) formed through the rib 74 and a hole 183 formed through the supporting block 170, respectively.

Figure 9:
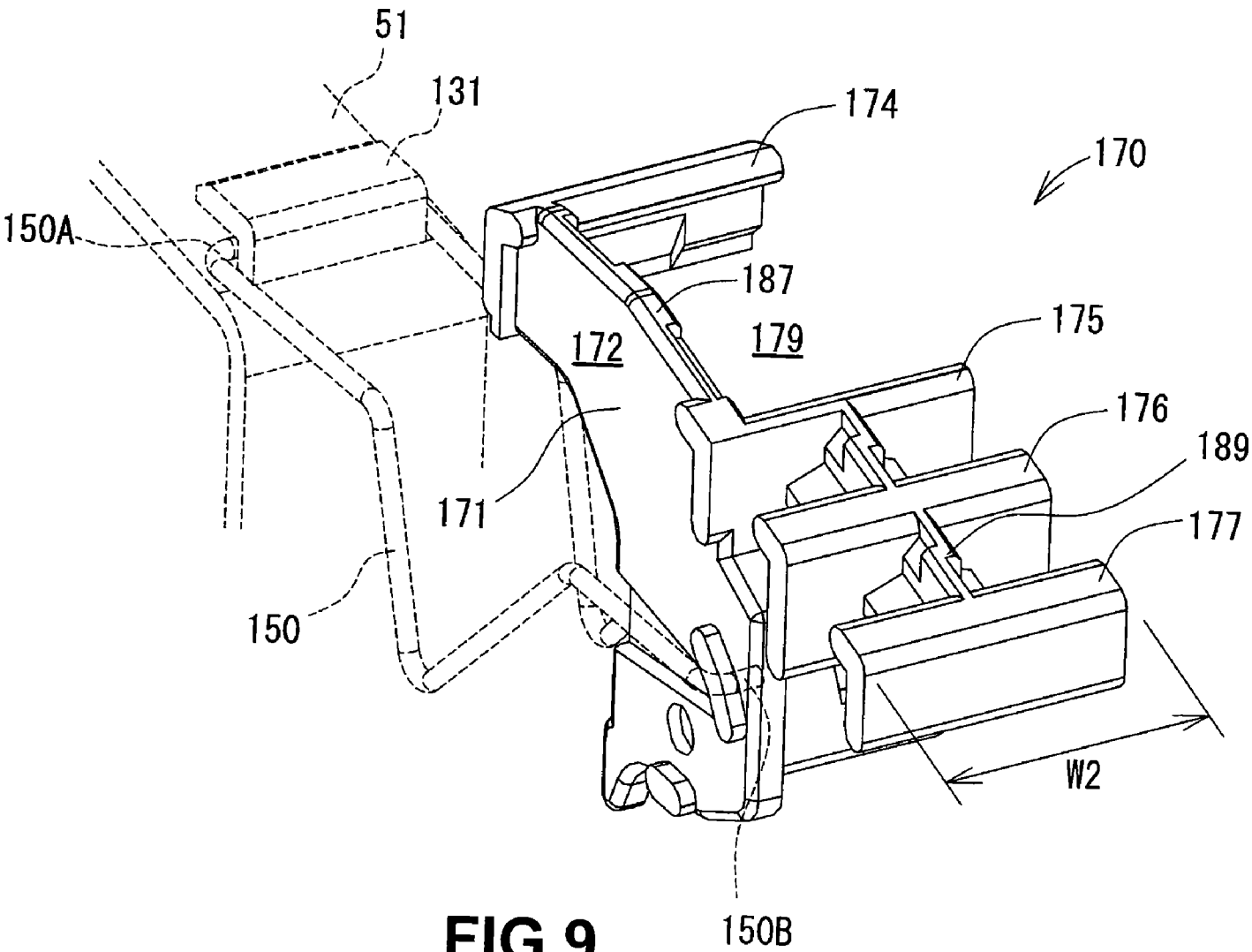
FIG. 9 is a perspective view of a supporting member, such as a supporting block, according to an embodiment of the present invention.

Referring to FIGS. 7, 9, and 10, the supporting block 170 is depicted. In FIG. 9, a portion of the outer peripheral wall 51 and a portion of the protecting member 150 are illustrated in broken lines for the convenience of description. The supporting block 170 is configured to support the shaft 77 and to support the pair of films 65 which may bend toward the ink chamber 100. The supporting block 170 is positioned in a lower portion of the ink chamber 100, e.g., in the space 102. The supporting block 170 may be configured to be removable from the frame 50.

The supporting block 170 may comprise a plate 171 and a plurality of ribs 174-177. The plate 171 and the ribs 174-177 may comprise the same material as the frame 50.

Figure 10D:
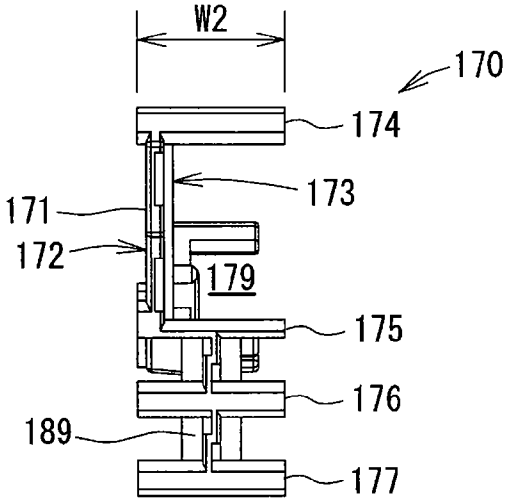
FIG. 10(D) is a plane view of the supporting block of FIG. 9.
Figure 10C:
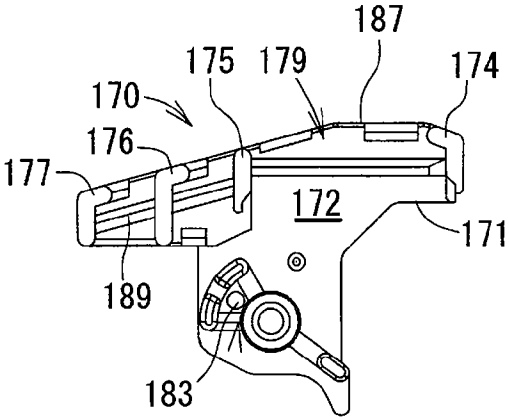
FIG. 10(C) is a right side view of the supporting block of FIG. 9.
Figure 10A:
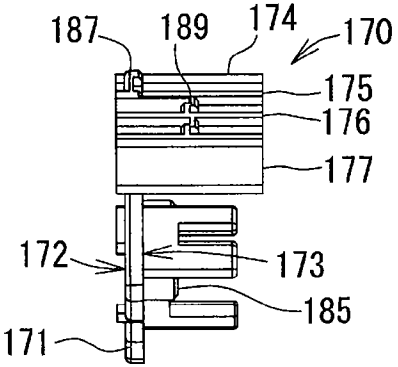
FIG. 10(A) is a front view of the supporting block of FIG. 9.
Figure 10B:
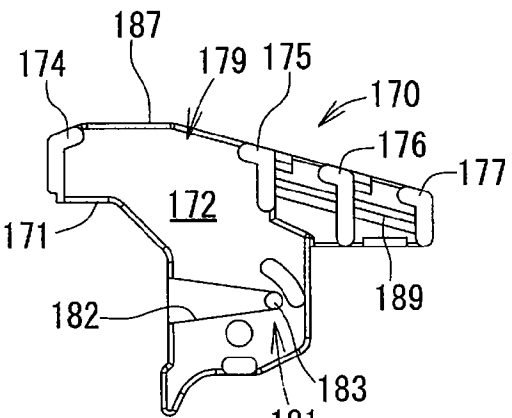
FIG. 10(B) is a left side view of the supporting block of FIG. 9.

The rib 174 and the rib 175 may extend in a direction perpendicular to a first surface 172 of the plate 171. Each of the ribs 174 and 175 may be substantially L-shaped, as shown in FIG. 10(B). The rib 174 and the rib 175 may be positioned adjacent to an upper end 187 of the plate 171. The rib 174 and the rib 175 are separated from each other by a predetermined distance. Consequently, an opening 179 which may have a substantially C-shape may be formed by the plate 171, the rib 174, and the rib 175. A portion of the first portion 75 of the pivotable member 70 may be positioned in the opening 179, and the pivotable member 70 may be pivotable within the range defined by the opening 179.

The supporting block 170 also may comprise a supporting portion 189 extending from the rib 175 substantially in the depth direction 33. The supporting portion 189 extends from substantially a widthwise center of the rib 175 toward the direction away from the rib 174. The rib 176 and the rib 177 may be positioned on the supporting portion 189. The rib 176 and the rib 177 are separated from each other by a predetermined distance. Therefore, the ribs 174-177 are positioned at dispersed places in the space 102.

Each of the rib 176 and the rib 177 may be substantially L-shaped. Each of the ribs 176 and 177 may extend in the same direction as the ribs 174 and 175 extend, and may have the same width W2 as the ribs 174 and 174. Each of the ribs 176 and 177 may extend the same distance from the supporting portion 189 in opposite directions.

The width W2 of the ribs 174-177 may be selected, such that the pair of films 65 do not contact the pivotable member 70 when the pair of films 65 are drawn toward the ink chamber 100. More specifically, the width W2 of the ribs 174 and 175 may be greater than a width W1 of the float portion 73, which is the portion of the pivotable member 70 which has the greatest width.

A groove 182 may be formed in a lower portion of the first surface 172 of the plate 172. The groove 182 may have a substantially triangular shape. A hole 183 may be formed through the plate 172 at a vertex 181 of the triangular groove 182. When one end 150B of the protecting member 150 is pushed along the groove 182 toward the vertex 181 with the supporting block 170 disposed in the space 102, the end 150B is guided to the vertex 181, and then is inserted into the hole 183. The end 150B of the protecting member 150 is thereby readily inserted into the hole 183.

A cylindrical tube 185 may be formed on a second surface 173 of the plate 172, and an end of the shaft 77 may be received in the cylindrical tube 185. The supporting block 170 is attached to the rib 74 with the second surface 173 facing the rib 74, such that the shaft 77 is inserted into the shaft hole 78 of the pivotable member 70, one end of the shaft 77 is received in the cylindrical tube 185 of the supporting block 170, and the other end of the shaft 77 is received in the cylindrical tube 67 of the rib 74. The pivotable member 70 is thereby pivotably supported, and a portion of the first portion 75 of the pivotable member 70 is positioned in the opening 179. Moreover, the ribs 174-177 extend perpendicular to and between the left side face 45 and the right side face 46.

Because the supporting block 170 is positioned in the space 102 of the ink chamber 100, even though the pair of films 65 are drawn towards the ink chamber 100 due to the pressure differential between the interior and exterior of the ink chamber 100 when ink is introduced into the ink chamber 100, the inner surfaces of the pair of films 65 contact ribs 174-177 of the supporting block 170. Therefore, deformation of the pair of films 65 is suppressed, which maintains the capacity of the ink chamber 100 at a maximum capacity. Moreover, when an external force is applied to the housing 26, which causes the housing 26 to deform toward the container body 20, the deformation of the housing 26 may be suppressed by the ribs 174-177.

Referring to FIGS. 1-4, the slider 27 is depicted. The slider 27 may have a container shape, and may be configured to accommodate a front portion of the container body 20 therein. The slider 27 may have a flat shape corresponding to the outer shape of the front portion of the container body 20. The slider may comprise a front wall 161 facing and covering the front face 41 of the container body 20, a top wall 163 covering at least a portion of the top face 43 of the container body 20, a bottom wall 164 covering at least a portion of the bottom face 44 of the container body 20, a left wall 165 covering at least a portion of the left side face 45 of the container body 20, and a right wall 166 covering at least a portion of the right side face 46 of the container body 20. A portion of the front portion 28 of the housing 26 may be positioned between the top wall 163 and the at least a portion of the top face 43, another portion of the front portion 28 may be positioned between the bottom wall 164 and the at least a portion of the bottom face 44, still another portion of the front portion 28 may be positioned between the left wall 165 and the at least a portion of the left side face 45, and yet another portion of the front portion 28 may be positioned between the right wall 166 and the at least a portion of the right side face 46. The walls 161, and 163-166 may define a space therein, which is configured to accommodate the front portion of the container body 20.

The slider 27 may comprise supporting bars 168 and 169, slide grooves 17 and 18, and the openings 110 and 111. The supporting bar 168 may be configured to support the coil spring 23, and the supporting bar 169 may be configured to support the coil spring 24. The supporting bars 168 and 169 may be positioned on a surface of the front wall 161 facing the front face 41 of the container body 20. The supporting bar 168 may be at a position corresponding to the spring receiver 23A, and the supporting bar 169 may be at a position corresponding to the spring receiver 24A.

The supporting bars 168 and 169 may extend from the surface of the front wall 161 in the depth direction 33 of the container body 20. When the front portion of the container body 20 is inserted into the slider 27 when the coil spring 23 is stored in the spring receiver 23A and the coil spring 24 is stored in the spring receiver 24A, the supporting bar 168 is inserted into the coil spring 23 and the supporting bar 169 is inserted into the coil spring 24. Accordingly, the coil springs 23 and 24 may be supported by the supporting bars 168 and 169, respectively. The direction of expansion and contraction of the coil springs 23 and 24 may be limited in the depth direction of the container body 20.

The coil springs 23 and 24 may comprise compression coil springs, e.g., the coil springs 23 and 24 may be compressed and stored in the spring receivers 23A and 24A, respectively, when the front portion of the container body 20 is inserted into the slider 27. Therefore, the coil springs 23 and 24 may urge or bias slider 27 in the direction away from the front face 41 of the container body 20 independent of the position of the slider 27.

The slide groove 17 may be formed in the top wall 163, and a cross-sectional shape of the slide groove 17 may have a substantially inverted U-shape. The supporting member 115 may be inserted into the slide groove 17, and a projecting strip 120 may extend from a bottom surface of the top wall 163 toward an interior of the slide groove 17. Therefore, the slide groove 17 may be narrowed by the projecting strip 120. The slide groove 18 may be formed in the bottom wall 164, and a cross-sectional shape of the slide groove 18 may be substantially a U-shape. The supporting member 116 may be inserted into the slide groove 18, and a projecting strip 126 may extend from a top surface of the bottom wall 164 toward an interior of the slide groove 18. Therefore, the slide groove 18 may be narrowed by the projecting strip 126.

During insertion of the front portion of the container body 20 into the slider 27, the supporting member 115 may be inserted into the slide groove 17, and the supporting member 116 may be inserted into the slide groove 18. When the supporting member 115 is inserted into the slide groove 17, the projecting strip 120 and the engaging claw 15 may contact each other. Then, when the supporting member 115 is further inserted, the supporting member 115 may bend downward, and the engaging claw 15 may move to be positioned over the projecting strip 120. When the engaging claw 15 has moved over the projecting strip 120, the slider 27 and the container body 20 may not be disassembled because the engaging claw 15 is received by the projecting strip 120. The supporting member 116 also may be inserted into the slide groove 18 in the same manner.

When the front portion of the container body 20 is inserted into the slider 27, the slider 27 is urged away from the front face 41 by the coil springs 23 and 24. Therefore, unless an external force is applied to the slider 27, the slider 27 remains in the first position (shown in FIG. 3(B)) corresponding to the slider's 27 furthest distance from front face 41 of the container body 20. The slider 27 remains in the first position by the contact between the projecting strip 120 and the engaging claw 15 and the contact between the projecting strip 126 and the engaging claw 16. Nevertheless, when an external force greater than the biasing force is applied to the front wall 161 of the slider 27, the slider 27 slides from the first position to the second position (shown in FIG. 3(A)) corresponding to the slider's 27 closest distance to front face 41 of the container body 20.

The opening 110 may be formed through the front wall 161 adjacent to the upper end of the front wall 161. The opening 110 may be formed at a position corresponding to the air communication valve mechanism 80. The opening 110 may allow a guide 204 and a rod 244 of an opener 200 (see FIG. 11) to be inserted therethrough, and may have a substantially circular shape.

The opening 111 may be formed through the front wall 161 adjacent to the lower end of the front wall 161. The opening 111 may be formed at a position corresponding to the ink supply valve mechanism 90. The opening 111 may have a size which is sufficient to allow the cap 95 of the ink supply valve mechanism 90 to be inserted therein, and when the slider 27 is slid from the first position (see FIG. 3(B)) to the second position (see FIG. 3(A)), the cap 95 emerges from the opening 111.

Referring to FIGS. 11-19, an ink cartridge assembly is depicted. The ink cartridge assembly comprises the ink cartridge 10 and an opener 200. The opener 200 may be configured to cover the air communication valve mechanism 80 and the ink supply valve mechanism 90 when the opener 200 is attached to the ink cartridge 10, and also may be configured to cause the air communication valve mechanism 80 to open the opening 81. The opener 200 may comprise a seat 206, a cover 208, an operation member 210, and a shaft 212.

The seat 206 may be configured to be directly attached to the ink cartridge 10. The seat 206 may comprise the same resin material as the frame 50, and may be manufactured using injection-molding. The seat 206 may have a hollow shape opening in an attachment direction 224 along which the opener 200 is attached to the ink cartridge 10. The attachment direction 224 may be parallel to a direction in which the rod 88 extends from the valve member 87 of the air communication valve mechanism 80. The seat 206 may comprise an attachment portion 214 configured to be attached to and contact the ink cartridge 10. The seat 206 also may comprise the two arms 218 and 219 extending from the attachment portion 214 in the attachment direction 224. The arms 218 and 219 are separated by a particular distance in the height direction of the seat 206. The arm 218 may be positioned at a position corresponding to the engaging claw 15 of the supporting member 115, and the arm 219 may be positioned at a position corresponding to the engaging claws 144 of the translucent portion 140.

Figure 14D:
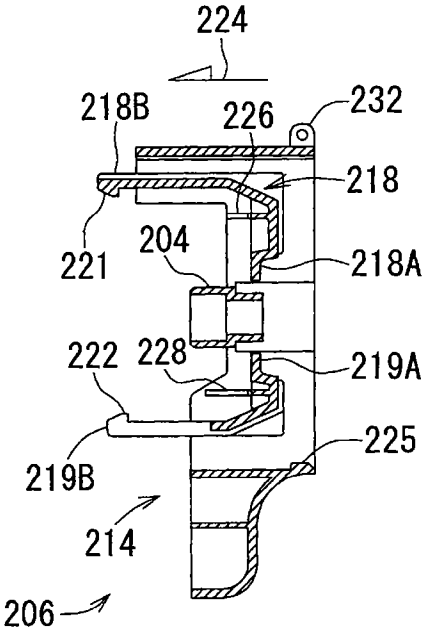
FIG. 14(D) is a cross-sectional view of the seat of FIG. 14(C) taken along a line XIVD-XIVD in FIG. 14(C).
Figure 14C:
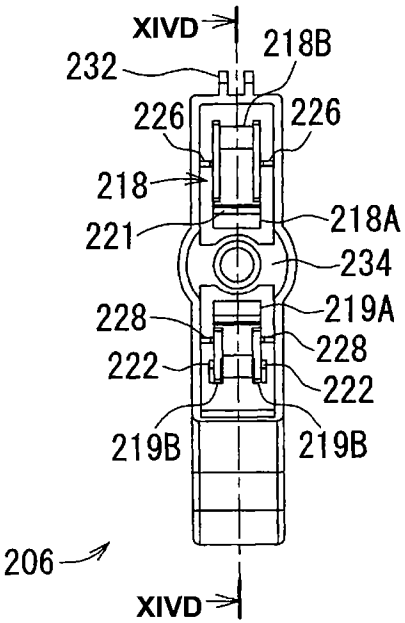
FIG. 14(C) is a front view of the seat of FIG. 14(A).
Figure 14A:
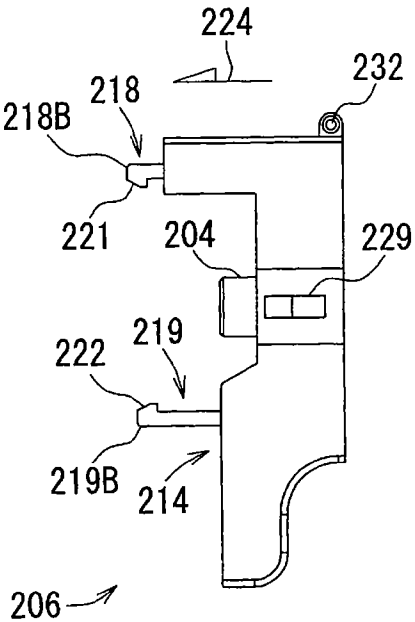
FIG. 14(A) is a side view of a seat of the opener of FIG. 11.
Figure 14B:
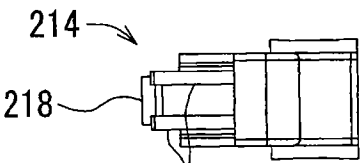
FIG. 14(B) is a bottom view of the seat of FIG. 14(A).
Figure 15D:
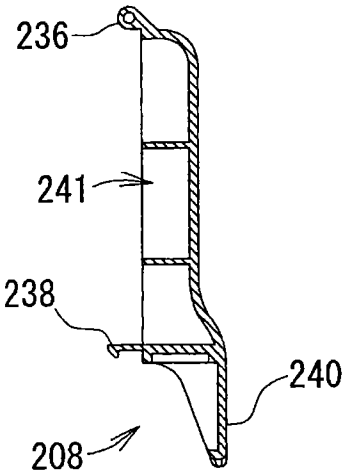
FIG. 15(D) is a cross-sectional view of the cover of FIG. 15(C) taken along a line XVD-XVD in FIG. 15(C).
Figure 15C:
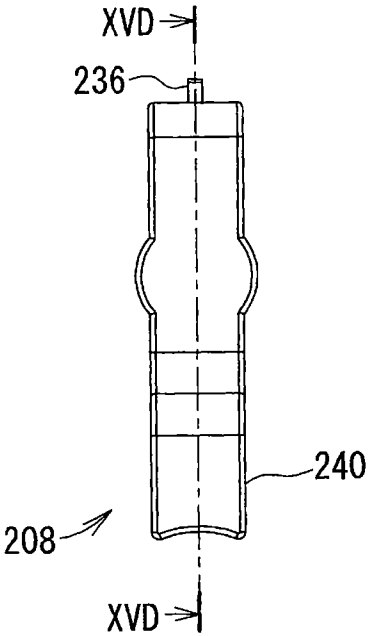
FIG. 15(C) is a front view of the cover of FIG. 15(A).
Figure 15A:
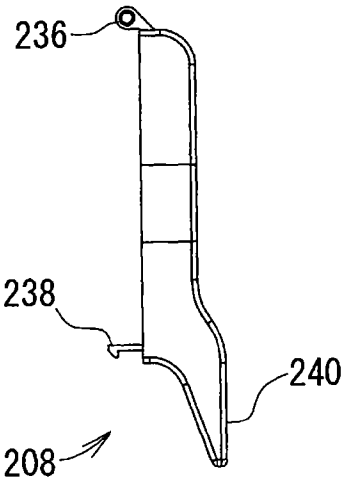
FIG. 15(A) is a side view of a cover of the opener of FIG. 11.
Figure 15B:
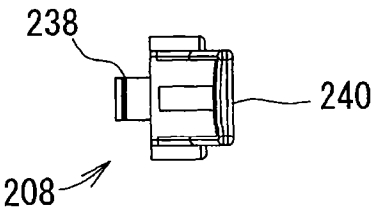
FIG. 15(B) is a bottom view of the cover of FIG. 15(A).

Referring to FIG. 14(D), the arm 218 may be substantially hook shaped. Supporting portions 226 may be positioned between a proximal end 218A and a distal end 218B of the arm 218. Referring to FIG. 14(C), the supporting portions 226 connect the inner wall surface of the seat 206 and the arm 218. Accordingly, the arm 218 is supported by the supporting portions 226 in the interior of the seat 206. Because the arm 218 is supported in this manner, when no external force is applied to the proximal end 218A of the arm 218, the arm 218 is in an engaging position, as indicated by a solid line in FIG. 18, in which the arm 218 is engageable with the container body 20. Nevertheless, when an external force is applied to the proximal end 218A of the arm 218 in the attachment direction 224, the arm 218 moves, and the distal end 218B is retracted outward i.e., upward in FIG. 14(D), such that the arm 218 moves to a releasing position, as indicated by a broken line in FIG. 18, in which the arm 218 is disengaged from the container body 20.

Referring to FIG. 14(D), the arm 219 may be substantially hook shaped. The arm 219 may be bifurcated from a proximal end 219A to a pair of distal ends 219B, such that the arm 219 is separated into two branches towards the distal ends 219B. The positions of the two bifurcated distal ends 219B correspond to the two engaging claws 144 of the translucent portion 140, respectively. Supporting portions 228 may be positioned between the proximal end 219A and the distal ends 219B of the arm 219. Referring to FIG. 14(C), the supporting portions 228 connect the inner wall surface of the seat 206 with the arm 219. Accordingly, the arm 219 is supported by the supporting portions 228 in the interior of the seat 206. Because the arm 219 is supported in this manner, when no external force is applied to the proximal end 219A of the arm 219, the arm 219 is in an engaging position, as indicated by a solid line in FIG. 18, in which the arm 219 is engageable with the container body 20. Nevertheless, when an external force is applied to the proximal end 219A of the arm in the attachment direction 224, the arm 219 moves, and the distal ends 219B retract outward, i.e., downward in FIG. 14(D), such that the arm 219 moves to a releasing position, as indicated by a broken line in FIG. 18, in which the arm 219 is disengaged from the container body 20.

Figure 11:
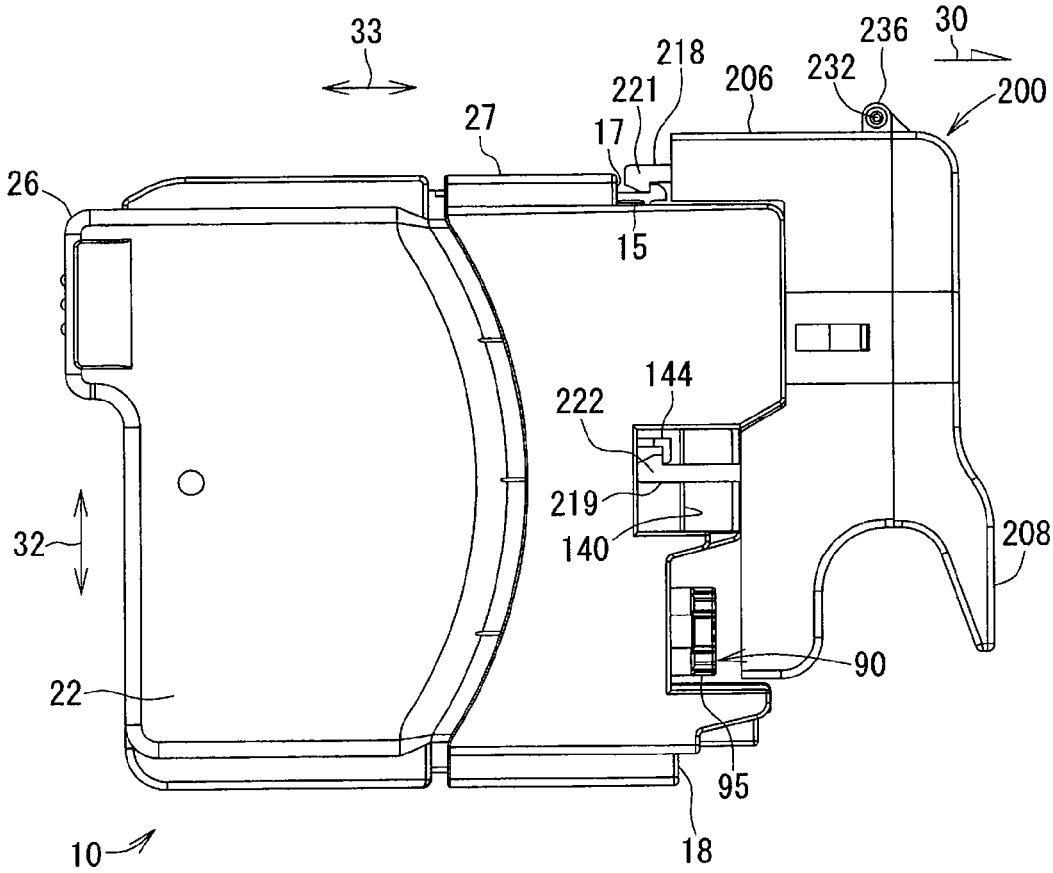
FIG. 11 is a side view of an ink cartridge assembly comprising the ink cartridge of FIGS. 1(A) and 1(B) and an opener, according to an embodiment of the present invention.
Figure 12:
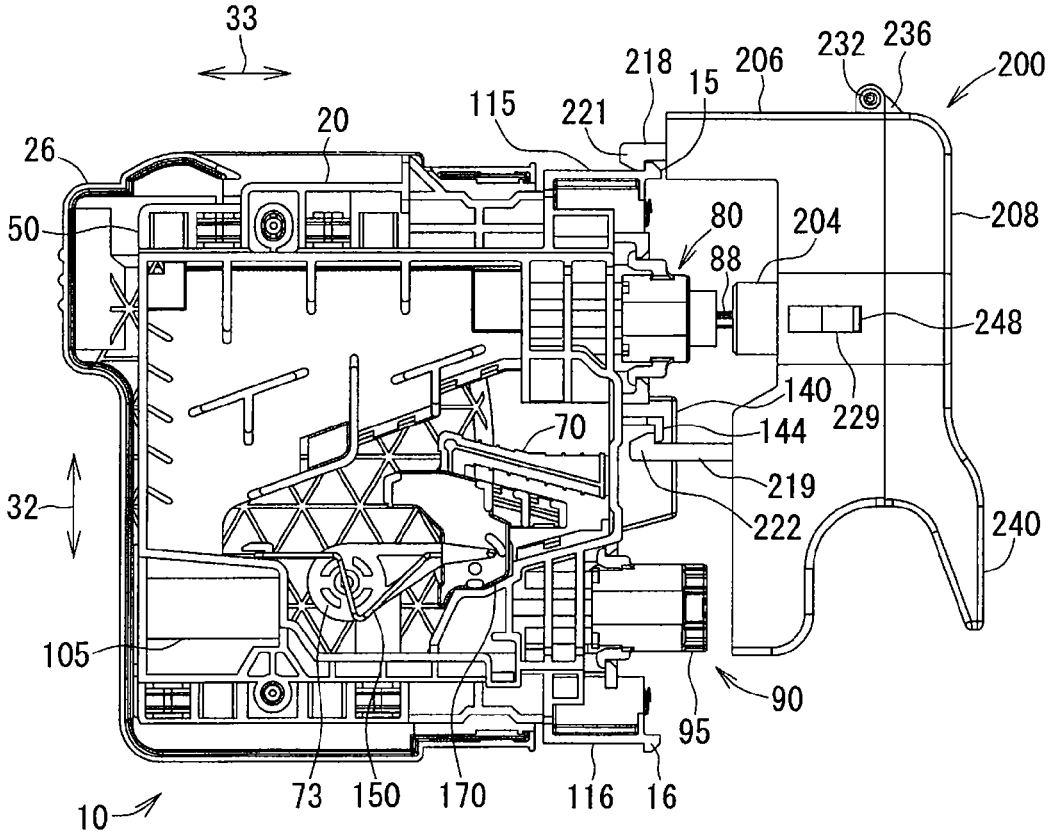
FIG. 12 is a side view of the ink cartridge assembly of FIG. 11, in which a housing and the movable member are omitted.

A hook-shaped engaging claw 221 may be formed on the distal end 218B of the arm 218, and the engaging claw 221 may be configured to engage the engaging claw 15 of the supporting member 115. Hook-shaped engaging claws 222 are formed on the distal ends 219B of the arm 219, respectively, and the engaging claws 222 are configured to engage the engaging claws 144 of the translucent portion 140, respectively. Referring to FIGS. 11 and 12, the seat 206 may be attached to the container body 20 by the engagement between the engaging claw 221 and the engaging claw 15 and the engagement between the engaging claws 222 and the engaging claws 144, respectively.

The attachment portion 214 may comprise a substantially cylindrical guide 204. The guide 204 may be positioned at a position corresponding to the opening 110 of the slider 27. When the seat 206 is attached to the ink cartridge 10, the guide 204 is inserted into the opening 110. The guide 204 has an inner hole (not numbered) formed therethrough, and a rod 244 of the operation member 210 is configured to be inserted into the inner hole of the guide 204.

A bearing 232 may be formed through the seat 206. The cover 208 may be attached to the seat 206 and may be configured to be pivotable about the shaft 212 which is inserted into the bearing 232 and a bearing 236 of the cover 208.

Referring to FIG. 14(C), a storage section 234 may be formed in the interior of the seat 206. The storage section 234 may be configured to store the operation member 210 and to slidably support the operation member 210 therein. The storage section 234 may be defined by a side wall of the seat 206 having a shape corresponding to the shape of the operation member 210.

Figure 13:
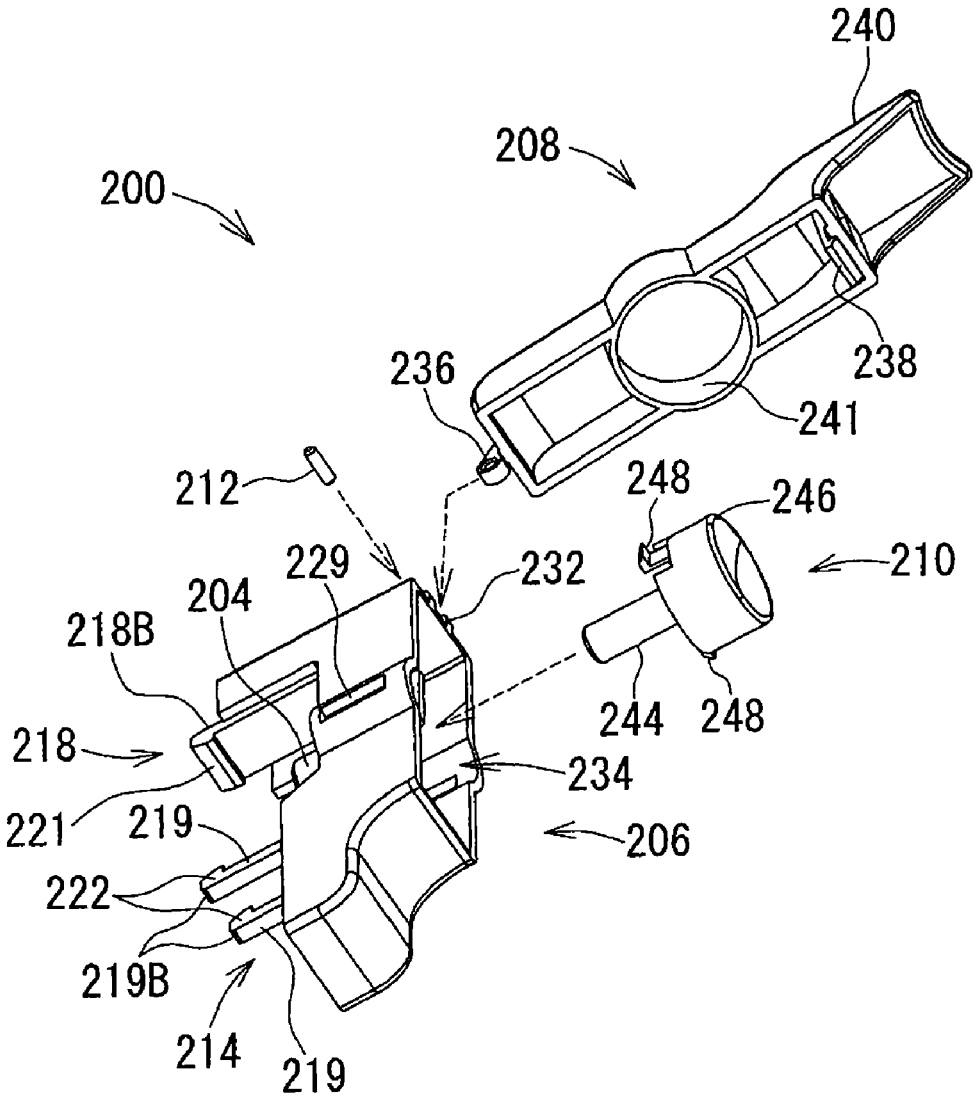
FIG. 13 is an exploded, perspective view of the opener of FIG. 11.

Referring to FIGS. 13 and 15, the cover 208 may comprise an engaging claw 238. When the cover 208 is moved to be positioned onto the seat 206, the engaging claw 238 engages a catch 225 positioned on the seat 206. When a lever portion 240 positioned at the end of the cover 208 receives a force, the lever portion 240 moves to disengage the engaging claw 238 from the catch 225.

The cover 208 may comprise a storage section 241 configured to receive, e.g., store, a pressing portion 246 of the operation member 210 therein. The storage section 241 may be configured to store the pressing portion 246 therein at least when the cover 200 is closed with respect to the seat 206.

Figure 16B:
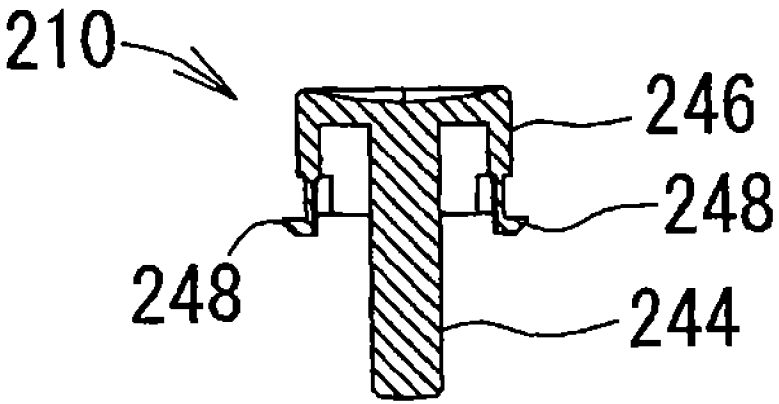
FIG. 16(B) is a cross-sectional view of the operation member of FIG. 16(A) taken along a line XVIB-XVIB in FIG. 16(A).
Figure 16A:
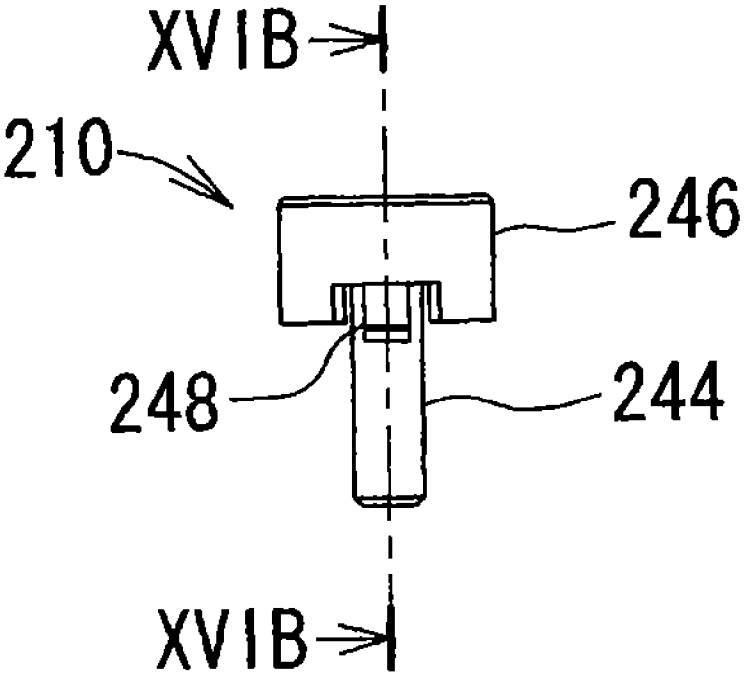
FIG. 16(A) is a side view of an operation member of the opener of FIG. 11.

Referring to FIGS. 13 and 16, the operation member 210 may be configured to be stored in the storage section 234 of the seat 206. The operation member 210 may have a mushroom shape, and may comprise the rod 244 and the pressing portion 246.

The rod 244 may have a cylindrical shape. The diameter of the rod 244 may be less than the diameter of the inner hole of the guide 204, and therefore, the rod 244 may be inserted into the inner hole of the guide 204. The pressing portion 246 is connected to an end of the rod 244. The pressing portion 246 may comprise two engaging claws 248.

Referring to FIG. 13, a method of assembling the opener 200 is described. In this exemplary method, the bearing 232 of the seat 206 and the bearing 236 of the cover 208 may be aligned, and then the shaft 212 may be inserted into the bearings 232 and 236. Subsequently, the operation member 210 may be stored in the storage section 234. When the operation member 210 is stored in the storage section 234, the rod 244 is inserted into the inner hole of the guide 204. Then, the engaging claws 248 may be fitted into elongated holes 229 formed through the side wall of the seat 206.

The engaging portion of the engaging claws 248, which engage the elongated holes 229, respectively, may have a surface area which is less than the surface area of the elongated holes 229 in the elongated direction of the elongated holes 229, e.g., a width of the engaging portion of the elongating claws 248 may be less than a diameter of the elongated holes 229. The engaging claws 248 are configured to slide within the elongated holes 229 between one end of the elongated holes 229 and the other end of the elongated holes 229. More specifically, the operation member 210 may be configured to move between a projected position in which the pressing portion 246 projects from the seat 206, and a retracted position in which the pressing portion 246 is retracted into the seat 206. When the opener 200 is attached to the ink cartridge 10, and the operation member 210 is in the projected position, the operation member 210 is separated from the air communication valve mechanism 80. Nevertheless, when the operation member 210 moves from the projected position to the retracted position, the rod 244 contacts and pushes the valve member 87 of the air communication valve mechanism 80 to open the opening 81. After the operation member 210 is stored in the storage section 234, the cover 208 may be rotated towards the seat 206, such that the claw 238 of the cover 208 engages the catch 225 of the seat 206, which completes the method of assembling.

Figure 17:
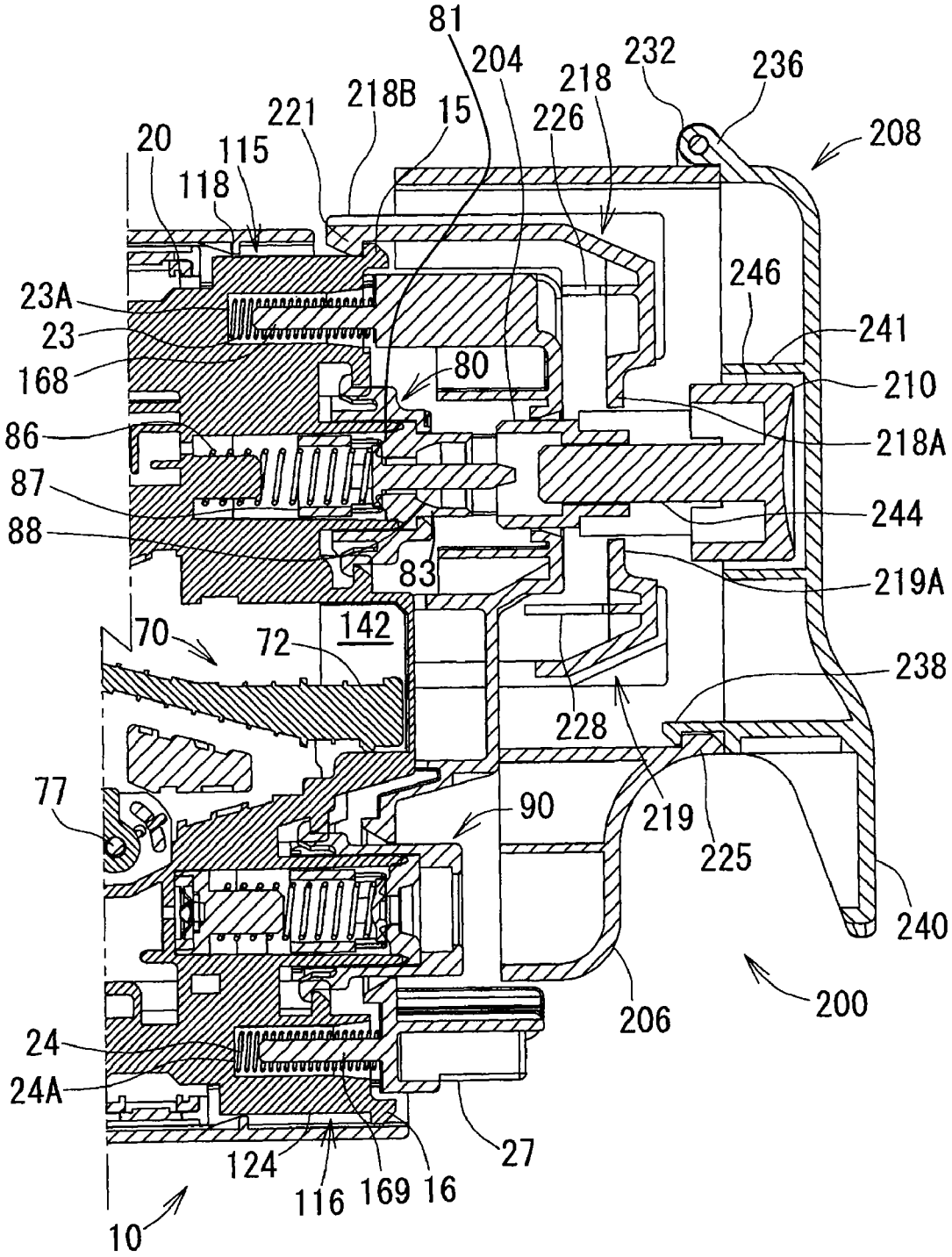
FIG. 17 is a partial, cross-sectional view of the ink cartridge assembly of FIG. 11.

Referring to FIG. 17, a method of attaching the opener 200 to the ink cartridge 10 is described. After ink is introduced into the ink chamber 100 and the pressure in the ink chamber 100 is reduced to be less than the atmospheric pressure, the slider 27 may be pressed to the second position, and then the opener 200 may be attached to the ink cartridge 10. For example, the attachment portion 214 of the opener 200 may be aligned to the front wall 161 of the slider 27, and the guide 204 may be positioned to face the opening 110. Then, when the opener 200 moves in a direction perpendicular to the front wall 161, the guide 204 may be inserted into the opening 110. Subsequently, when the opener 200 is further pressed, the engaging claw 221 of the arm 218 may contact the engaging claw 15. When this occurs, the arm 218 may be resiliently deformed, and the engaging claw 221 may move over the engaging claw 15 and engage the engaging claw 15. Similarly, the engaging claws 222 of the arm 219 may contact the engaging claws 144, the arm 219 may be resiliently deformed, and the engaging claws 222 may move over the engaging claws 144, such that the engaging claw 222 engage the engaging claws 144. Accordingly, the opener 200 may engage the container body 20 to attach to the ink cartridge 10.

The air communication valve mechanism 80 is covered by the opener 200 and is protected by the opener 200 with the opener 200 attached to the ink cartridge 10. Moreover, the slider 27 is retained at the second position against the biasing force of the coils springs 23 and 24.

Figure 18:
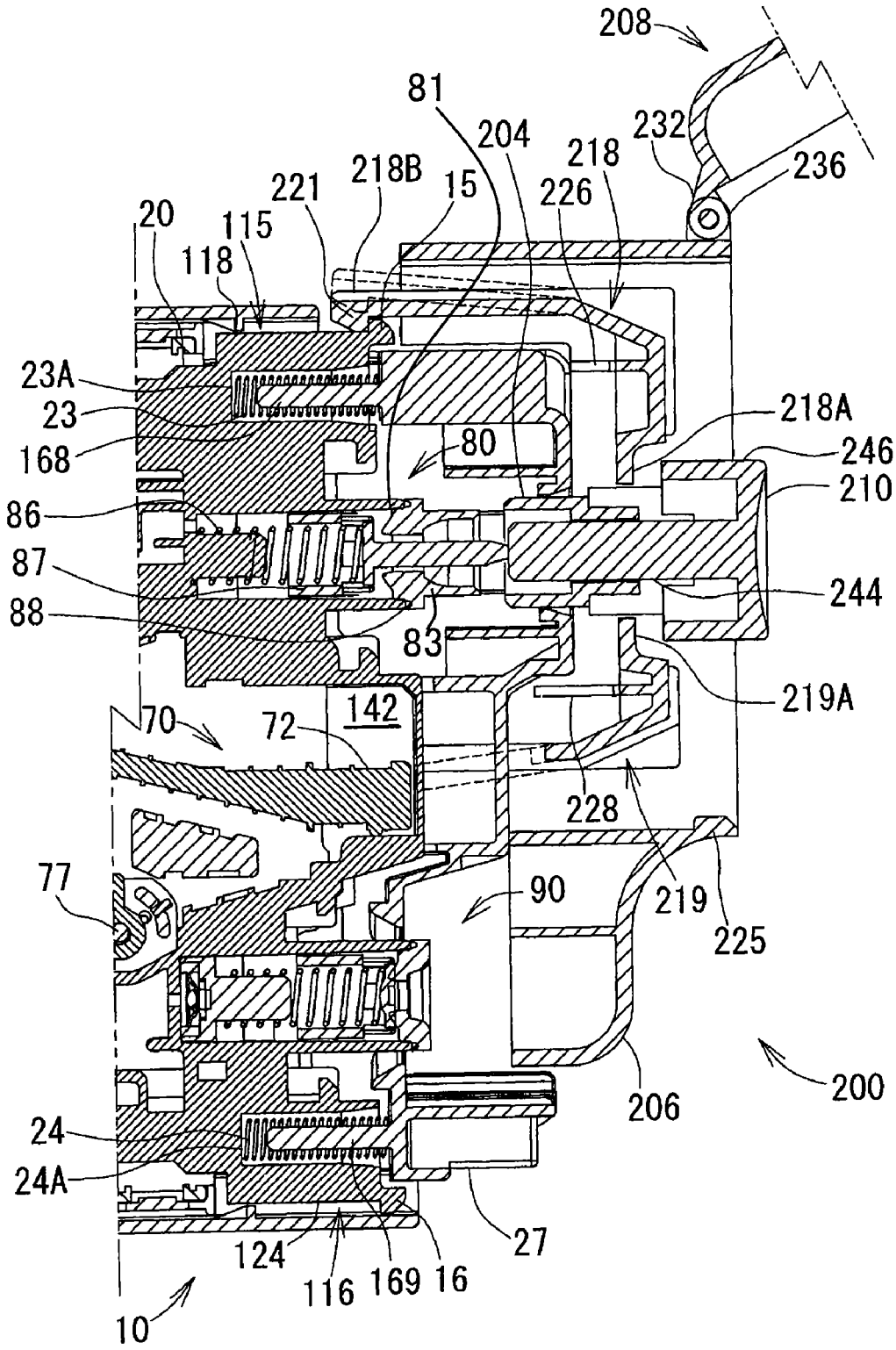
FIG. 18 is a partial, cross-sectional view of the ink cartridge assembly of FIG. 11, in which the operation member is pressed.
Figure 19:
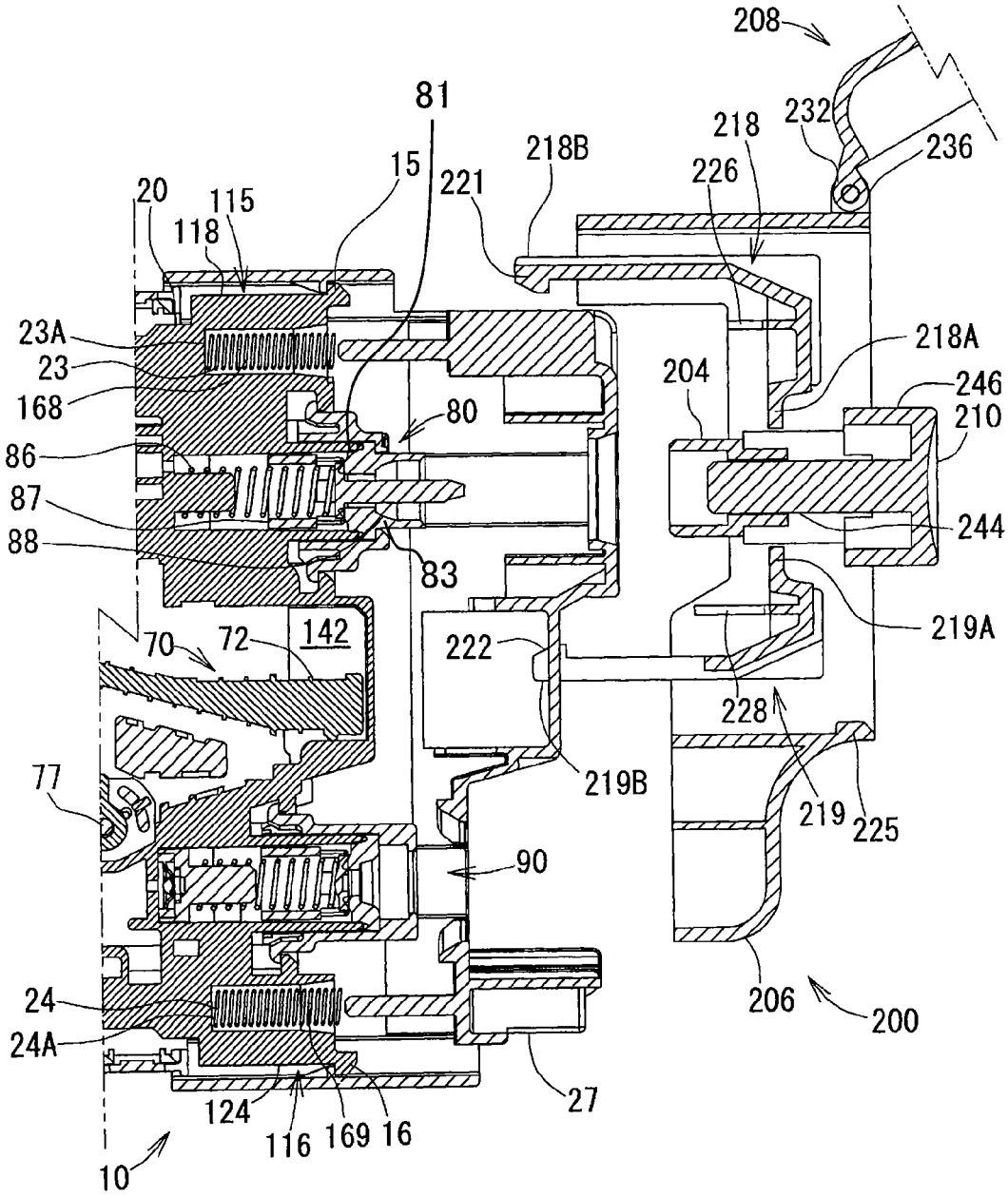
FIG. 19 is a partial, cross-sectional view of the ink cartridge assembly of FIG. 11, in which the opener is removed from the ink cartridge.

Referring to FIGS. 17-19, a method of removing the opener 200 from the ink cartridge 10 is described. The lever portion 240 of the cover 208 may be pressed to release the engagement between the cover 208 and the seat 206. Subsequently, as shown in FIG. 18, the cover 208 may be rotated to expose the pressing portion 246 of the operation member 210. When the pressing portion 246 is pressed toward the container body 20, the distal end of the rod 244 applies a force to the rod 88 extending from the valve member 87 to push the rod 88 toward the ink chamber 100. The valve member 87 then moves from the closed position in which the valve member 87 closes the opening 81 to the open position in which the valve member 87 opens the opening 81 against a biasing force of the spring 86. This allows the ink chamber 100 of the container body 20 to communicate with the atmosphere, such that the pressure in the ink chamber 100 is equalized with the atmospheric pressure.

When a further force is applied to the pressing portion 246, the pressing portion 246 contacts the proximal end 218A of the arm 218 and the proximal end 219A of the arm 219, respectively. When this occurs, the arm 218 is flexed by a pressing force applied to the proximal end 218A, the distal end 218B is retracted outward, i.e., upward in FIG. 18, and the arm 218 moves to the releasing position as indicated by the broken line in FIG. 18, which releases the engagement of the engaging claws 221 and 15. Similarly, the arm 219 may be flexed by a pressing force applied to the proximal end 219A, which releases the engagement of the engaging claws 222 and 144. Subsequently, the opener 200 may be removed from the ink cartridge 10 by pulling the opener 200. As such, when engaging claws 221 and 222 engage engaging claws 15 and 144, respectively, the opener 200 may cover the opening 81 and the air communication valve mechanism 80, and when a force is applied to the operation member 210 to move the operation member 210 toward the container body 20, the operation member 210 may apply a particular force to the valve member 87 to move the valve member 87 away from the opening 81 toward the ink chamber 100, and the operation member 210 also may disengage engaging claws 221 and 222 from the engaging claws 15 and 144, respectively.

In this manner, by operating the pressing portion 246 of the operation member 210, the opening 81 may be opened at substantially the same time that the engagement between the opener 200 and the ink container 20 is released. Therefore, the opening 81 may be opened reliably before mounting the ink cartridge 10 to a recording apparatus. Consequently, when the ink cartridge 10 is mounted to a recording apparatus, backflow of ink from a recording head to the ink chamber 100 is prevented.

In another embodiment of the present invention, the air communication valve mechanism 80 may be replaced by an adhesive member, e.g., a vinyl adhesive tape or film, which is attached to the container body 20 to cover and close the opening 81. The pressure in the ink chamber may be equalized with the atmospheric pressure by the rod 244 puncturing at least one portion of the adhesive member and pushing the at least one portion of the adhesive member away from the opening 81 and toward the ink chamber 100.

Figure 20:
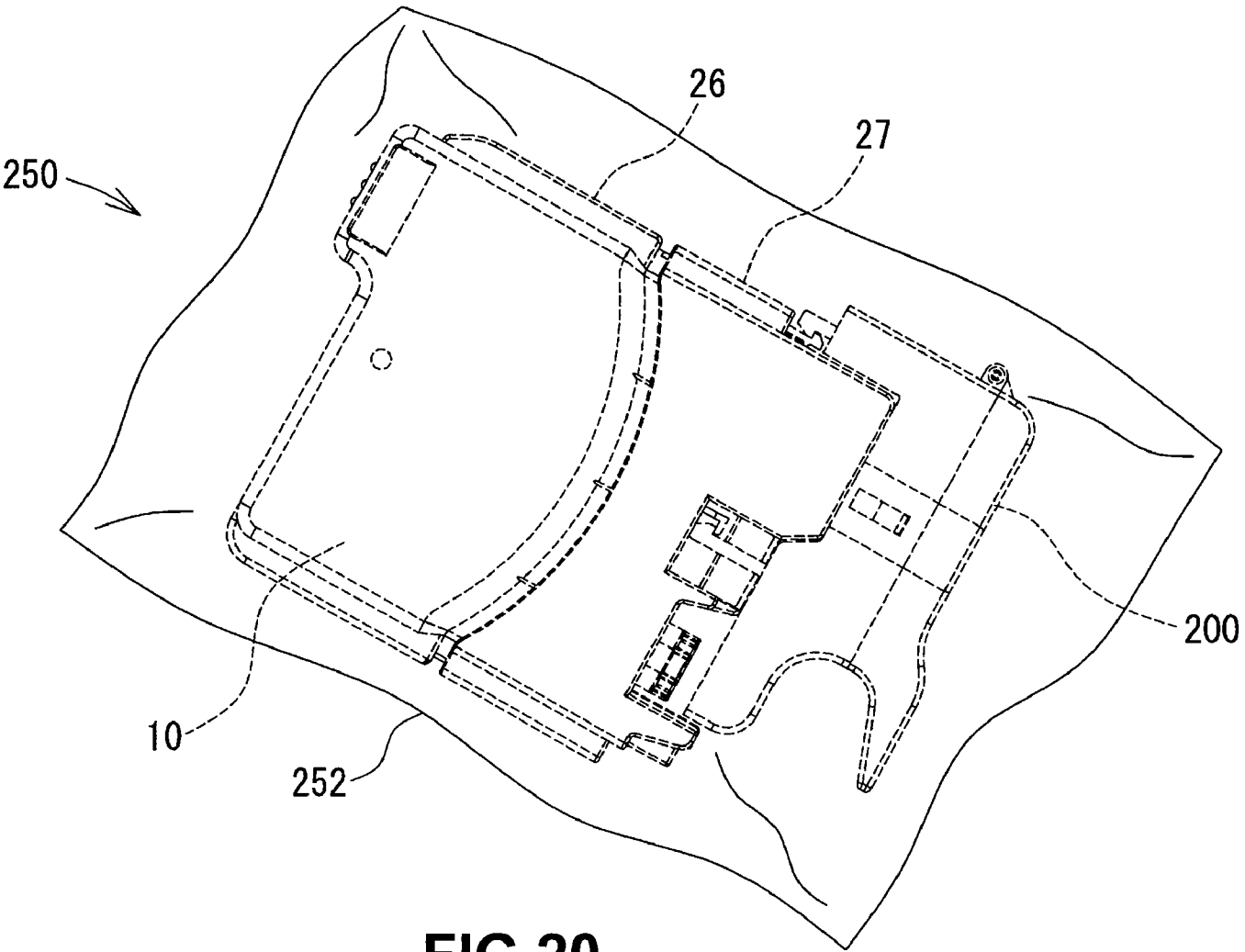
FIG. 20 is perspective view of a packaging arrangement, according to an embodiment of the present invention.

Referring to FIG. 20, a packaging arrangement 250 according to an embodiment of the present invention may comprise the ink cartridge 10 with the opener 200 attached thereto, and a packaging member, e.g., a package bag 252 configured to enclose the ink cartridge 10.

The ink cartridge 10 is enclosed in the packaging bag 252. The ink cartridge 10 may be shipped and sold in the packaging arrangement 250.

The packaging bag 252 may be liquid-proof, but may have some gas permeability. The pressure inside the package bag 252 may be depressurized to a pressure less than the pressure outside the package bag 252, e.g., the atmospheric pressure, by a suction pump (not shown). Moreover, the pressure inside the package bag 252 and outside the ink chamber 100 may be reduced to be less than the pressure inside the ink chamber 100. This pressure differential may suppress air gradually entering the ink chamber 100 through the pair of films 65 and suppress restoration of the pressure inside the ink chamber 100 to the atmospheric pressure when the ink cartridge 10 remains unused for a long time.

When no external force is applied to the slider 27, the slider 27 may be biased to the first position by coil springs 23 and 24. When the ink cartridge 10 is enclosed in the package bag 252 and the inside of the package bag 252 is depressurized while the slider 27 is in the first position, the slider 27 may be partly deformed by the pressure differential between the inside and outside of the package bag 252. More specifically, because the slider 27 may have the inner space, the left side wall 165 and the right side wall 166 of the slider 27 may be deformed inward. In particular, when the ink cartridge 10 is enclosed in the package bag 252 in the depressurized state for a long time, the slider 27 may be subjected to the deformation. When the slider 27 is deformed, the slider 27 may not slide relative to the ink container 20. In order to avoid this deformation, the packaging arrangement 250 may be manufactured as described below.

The shaft 77, the arm 70, the supporting block 170, and the protecting member 150 may be attached to the frame 50. The arm 70 and the supporting block 170 may be manufactured in advance using the injection molding. The arm 70 may be attached to the frame 50 such that the indicating portion 72 is positioned in the inner space 142 of the detection window 140. A resilient member, e.g., rubber, then may be press-fitted into the ink introduction chamber 105. After the resilient member is fitted in the ink introduction chamber 105, the openings 57 of the frame 50 may be covered and closed by the pair of films 65 to define the ink chamber 100 therein. More specifically, after the film 65 is placed on the frame 50 to cover the left side face 45 of the frame 50, the film 65 may be heated and adhered to the left side face 45 of the frame 50 by a thermal adhesion apparatus (not shown). Subsequently, another film 65 may be placed on the frame 50 to cover the right side face 46 of the frame 50, and the film 65 may be heated and adhered to the right side face 46 by the thermal adhesion apparatus.

After that, the air communication valve 80 may be attached to the frame 50 at the opening 81. More specifically, the spring 86, the valve member 87, the stopper 83 and the cap 85 may be attached to the frame 50. Subsequently, the ink supply valve 90 may be attached to the frame 50 at the opening 91. More specifically, the spring receiver 94, the spring 96, the valve member 97, the stopper 93, and cap 95 may be attached to the frame 50. With the openings 81 and 91 closed by the air communication valve 80 and the ink supply valve 90, the ink chamber 100 may be sealed from the outside of the ink chamber 100.

Air in the ink chamber 100 then may be discharged through the opening 91. More specifically, a suction tube of a decompression device (not shown) may be inserted through the opening 81 and may push the ink supply valve 90 to open the opening 91, and the decompression device may be activated to draw the air in the ink chamber 100. When the air in the ink chamber 100 is drawn by the decompression device, and the pressure inside the ink chamber 100 is lowered to a predetermined pressure, the decompression device may be stopped, and the suction tube may be pulled out of the opening 91. When the suction tube is pulled out of the opening 91, the opening 91 is closed by the ink supply valve 90. Therefore, the inside of the ink chamber 100 is maintained in a depressurized state.

After the interior of the ink chamber 100 is depressurized, an ink introduction needle may be inserted into the ink chamber 100 through the resilient member fitted in the ink introduction chamber 105 to introduce ink into the ink chamber 100. Since the inside of the ink chamber 100 is depressurized, ink readily may be introduced into the ink chamber 100 by the pressure differential between the inside and outside of the ink chamber 100. After a predetermined amount of ink has been introduced into the ink chamber 100, e.g., about 80% the capacity of the ink chamber 100, the ink introduction needle may be pulled out of the resilient member. When the ink introduction needle is inserted through the resilient member and then removed, an opening formed through the resilient member by the ink introduction needle may be closed by the resiliency of the resilient member. In this embodiment, after ink is introduced into the ink chamber 100, the pressure inside the ink chamber 100 may be about −60 kPa. The pressure differential between the inside and the outside of the ink chamber 100 may cause the pair of films 65 to flex towards the ink chamber 100. Nevertheless, the supporting block 170 may prevent the pair of films 65 from flexing.

Subsequently, the housing 26 may be attached to the frame 50. More specifically, the first cover member 21 may be attached to the right side face 46 of the frame 50, and the second cover member 22 may be attached to the left side face 45 of the frame 50. Consequently, the first cover member 21 is positioned outside the film 65 which closes the right side face 46 of the frame 50, and the second cover member 22 is positioned outside the film 65 which closes the left side face 45 of the frame 50. The slider 27 then may be coupled to the ink container 20 via the coil springs 23 and 24.

Subsequently, before the ink cartridge 10 is placed in the package bag 252, the slider 27 may be moved to the second position against the urging forces of the coil springs 23 and 24.

The opener 200 may be attached to the ink cartridge 10 to retain the slider 24 in the second position. The ink cartridge 10 with the opener 200 attached thereto then may be placed in the package bag 252.

Subsequently, a portion of an opening of the package bag 252 may be closed by adhering the edge of the opening while a part of the opening may not be closed. The suction tube of the decompression device then may be inserted into the package bag 252 through the unclosed part of the opening, and the decompression device may be activated to discharge air in the package bag 252.

In this embodiment, after the pressure inside the package bag 252 is reduced to approximately −70 kPa, the suction tube may be pulled out and the unclosed part of the opening may be closed by adhering the edge of the unclosed part of the opening. Accordingly, the pressure outside the ink chamber 100 and inside the package bag 252 may be approximately 10 kPa less than the pressure inside the ink chamber 100.

With the packaging arrangement 250 described above, even though the ink cartridge 10 is enclosed in the package bag 252 in a depressurized state, the deformation of the slider 27 may be suppressed by the front portion 28 of the housing 26 contacting the left side wall 45 and the right side wall 46 of the slider 27 because the slider 27 is in the second position. Moreover, deformation of the housing 26 may be suppressed by the outer wall 51 and the inner walls or inner ribs 52 of the frame 50 and the ribs 174-177 of the supporting block 170, each of which supports the housing 26 from inside.

Because the slider 27 is retained in the second position by the opener 200, the packaging arrangement 250 may be downsized.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A packaging arrangement, comprising:

an ink cartridge, comprising:

a body comprising a particular face, wherein the body has at least a portion of an ink chamber defined therein, and the ink chamber is configured to store ink;

a movable member configured to move between a first position and a second position relative to the body, wherein a distance between the second position and the particular face of the body is less than a distance between the first position and the particular face of the body; and at least one resilient member disposed between the particular face of the body and the movable member, wherein the at least one resilient member is configured to expand and to contract to move the movable member relative to the body between the first position and the second position, and the at least one resilient member applies a biasing force to the movable member to bias the movable member into the first position; and a packaging member enclosing the ink cartridge, wherein a pressure inside the packaging member is less than a pressure outside the packaging member, and the movable member is retained in the second position when the ink cartridge is enclosed within the packaging member.

2. The packaging arrangement of claim 1, wherein the particular face of the body has a first opening formed therethrough, and the body comprises a sealing member configured to close the first opening, wherein the movable member comprises a particular wall facing the particular face of the body, and the particular wall has a second opening formed therethrough at a position corresponding to the first opening.

3. The packaging arrangement of claim 2, wherein the body further comprises:

a first face; and a second face opposite the first face, wherein each of first face and the second face extends from the particular face, wherein the movable member further comprises:

a first wall covering at least a portion of the first face of the body; and a second wall covering at least a portion of the second face of the body.

4. The packaging arrangement of claim 3, wherein the ink cartridge further comprises a particular rib disposed in the ink chamber and extending between the first face and the second face.

5. The packaging arrangement of claim 4, wherein the ink cartridge further comprises:

a pivotable member disposed in the ink chamber and configured to move within the ink chamber based on an amount of ink in the ink chamber; and a supporting member positioned in the ink chamber, wherein the supporting member is configured to pivotably support the pivotable member, and the supporting member comprises a further rib extending between the first face and the second face.

6. The packaging arrangement of claim 3, wherein the ink cartridge further comprises a housing enclosing at least a portion of the body, a first portion of the housing is positioned between the first wall and the at least a portion of the first face of the body, and a second portion of the housing is positioned between the second wall and the at least a portion of the second face of the body.

7. The packaging arrangement of claim 1, further comprising a retaining member configured to engage the body to retain the movable member in the second position.

8. The packaging arrangement of claim 1, wherein the body further comprises:

a first face; and a second face opposite the first face, wherein each of first face and the second face extends from the particular face, wherein the movable member further comprises:

a particular wall covering at least a portion of the particular face;

a first wall covering at least a portion of the first ace of the body; and a second wall covering at least a portion of the second face of the body.

9. The packaging arrangement of claim 8, wherein the ink cartridge comprises a particular rib disposed in the ink chamber and extending between the first face and the second face.

10. The packaging arrangement of claim 9, wherein the ink cartridge further comprises:

a pivotable member disposed in the ink chamber and configured to move within the ink chamber based on an amount of ink in the ink chamber; and a supporting member positioned in the ink chamber, wherein the supporting member is configured to pivotably support the pivotable member, and the supporting member comprises a further rib extending between the first face and the second face.

11. The packaging arrangement of claim 8, wherein the ink cartridge further comprises a housing enclosing at least a portion of the body, a first portion of the housing is positioned between the first wall and the at least a portion of the first face of the body, and a second portion of the housing is positioned between the second wall and the at least a portion of the second face of the body.

* * * * *